US005771875A

United States Patent [19]

Sullivan

[11] Patent Number: 5,771,875

[45] Date of Patent: Jun. 30, 1998

[54] GAS POWERED REPEATING GUN

[76] Inventor: Brian E. Sullivan, 517 N. Mountain Ave. #203, Upland, Calif. 91786

[21] Appl. No.: 433,248

[22] Filed: Apr. 28, 1995

[51] Int. Cl.[6] ..... F41B 11/00; F41B 11/02

[52] U.S. Cl. ..... 124/72; 124/73

[58] Field of Search ..... 124/37, 49, 51.1, 124/70–74, 76, 82

[56] References Cited

U.S. PATENT DOCUMENTS

| | | | |
|---|---|---|---|
| 964,810 | 7/1910 | Rieger . | |
| 1,743,576 | 1/1930 | Smith | 124/72 |
| 2,566,181 | 8/1951 | Fitch | 124/70 X |
| 2,737,942 | 3/1956 | Horowitz et al. | 124/82 X |
| 3,204,625 | 9/1965 | Shepherd | 124/74 |
| 3,369,535 | 2/1968 | Bonanno | 124/51.1 X |
| 3,494,344 | 2/1970 | Vadas et al. | 124/74 |
| 3,572,310 | 3/1971 | Chiba | 124/76 |
| 3,788,298 | 1/1974 | Hale | 124/76 |
| 4,083,349 | 4/1978 | Clifford | 124/74 X |
| 4,116,193 | 9/1978 | Chiba | 124/72 |
| 4,531,503 | 7/1985 | Shepherd | 124/76 |
| 4,936,282 | 6/1990 | Dobbins et al. | 124/74 |
| 5,063,905 | 11/1991 | Farrell | 124/72 |
| 5,078,118 | 1/1992 | Perrone | 124/74 |
| 5,257,614 | 11/1993 | Sullivan | 124/73 |
| 5,339,791 | 8/1994 | Sullivan | 124/73 |
| 5,349,939 | 9/1994 | Perrone | 124/76 |

FOREIGN PATENT DOCUMENTS

| | | | |
|---|---|---|---|
| 1264128 | 1/1990 | Canada . | |
| 285798 | 11/1989 | Japan | 124/72 |

*Primary Examiner*—John A. Ricci
*Attorney, Agent, or Firm*—Sheldon & Mak

[57] ABSTRACT

A gas powered repeating gun capable of firing projectiles with compressed gas comprising a stock section; a central section attached to the stock section; a barrel section attached to the central section; a barrel disposed within the barrel section; the barrel having a proximal and a distal end; a breech disposed proximate to the proximal end of the barrel; a primary reservoir capable of retaining at least about 50 projectiles, the reservoir being at least about 80% disposed within the stock section, the central section, the barrel section, an appendage disposed below the stock section, disposed below the barrel section, disposed below the central section or combinations thereof; a conveyance mechanism capable of delivering projectiles from the primary reservoir to the breech at a rate greater than about 300 per minute; and a firing mechanism capable of delivering discrete bursts of compressed gas to the breech and thereby firing projectiles at a rate greater than about 300 per minutes.

10 Claims, 15 Drawing Sheets

GAS POWERED REPEATING GUN

BACKGROUND

This invention relates generally to gas powered guns suitable for projecting light weight projectiles, and, specifically, to gas powered repeating guns suitable for projecting paint balls.

Gas powered guns suitable for projecting light weight projectiles have been in existence for some time. Within the last 15 years, gas powered guns adapted to project a semi-solid ball of paint have become very popular for playing out simulated combat games among adults. Typically, the "paint balls" used in such games weigh about 0.11 ounces and are about 0.7 inches in diameter. Such simulated combat games have become highly sophisticated, organized affairs. The number of adults who regularly participate in such paint ball competitions number in the hundreds of thousands.

To store projectiles, existing gas powered guns typically utilize hopper-like containers suspended above the guns where the containers are filled with projectiles which are fed into the gun for filing. The containers are separate units from the guns.

In many instances, the users rely on gas powered guns for practice purposes instead of using a real gun. Therefore, it is important for gas powered guns to have a feel and appearance similar to real guns such that the user can switch to using a real gun without the need for additional training or an adjustment period.

A disadvantage of existing gas powered guns using containers suspended above the guns is that the guns do not have a "gun-like" appearance because real guns do not utilize such containers suspended above them. The "look" of the gun is an important feature to its users who invariably prefer a more "gun-like" appearance. Further, because the containers are disposed above the guns, they greatly reduce efficient handling of the gun especially in training maneuvers.

A further disadvantage of such guns is that once the projectiles in the containers are all consumed, users must cease using the guns for a long period of time in order to refill the containers with projectiles. Therefore, not only the users must cease using the guns in the midst of training exercises, but the users must carry a supply of paint balls in a separate container and manually refill the containers. This unnecessary interruption in use of the guns prevents true simulation of training with real guns, because real guns utilize magazines of ammunition that can be quickly and easily exchanged with exhausted magazines. This ease of exchange enables prompt availability of the guns by quick reloading.

Another disadvantage of existing guns is that frequently projectiles are retained under force or spring compression for feeding the projectiles into the guns. The use of external pressure on fragile projectiles such as paint balls can lead to their premature bursting while in the gun. In order to withstand such pressure, the projectile must be made from heavy duty materials which increase manufacturing costs and result in heavy projectiles that are harder to transport and require increased gas pressure to propel.

Yet a further disadvantage of existing guns is a lack of different firing modes in a single gun. Generally, existing guns are either repeating or single firing guns. Therefore, existing guns cannot simulate real guns which have selectable firing modes such as single firing, semi-automatic, and fully automatic.

Existing guns are also prone to malfunction in extreme environmental conditions and under repeated use because such guns utilize friction seals in gas flow redirection valves used in the guns. Friction seals are generally made from flexible materials such as rubber which lose their intended characteristics in hot or cold temperatures or in repeated firing where friction generated heat can be prominent. Friction generated heat is especially important in repeating guns where several projectiles are fired in rapid succession. The aforementioned shortcomings of friction seals frequently lead to jamming of valves, rendering the guns inoperable. Therefore, the user either cannot use the gun in hot or cold temperatures, or must allow the gun to cool off after firing a few projectiles. Either alternative is undesirable.

Yet another disadvantage of existing guns is that although a repeat firing feature may be provided, such guns are not truly semiautomatic or fully automatic as in real guns. This is because such guns require a user to manually cock the gun by actuating a cocking mechanism, rather than relying on the gun to recock and reload itself.

Accordingly, there is a need for a gas powered repeating gun capable of firing projectiles with compressed gas which is "gun-like" in appearance and function, has multiple firing modes, can operate reliably in hot or cold temperature and in repeated firing, and does not require manual cocking or loading in semi-automatic or fully automatic modes.

SUMMARY

The invention satisfied these needs. The invention is a gas powered repeating gun capable of firing projectiles with compressed gas such as paint balls, the gun having a forward end and a rear end, and comprising: (a) a stock section; (b) a central section attached to the stock section; (c) a barrel section attached to the central section; (d) a barrel disposed within the barrel section, the barrel having longitudinal axis, a central bore, a proximal end and a distal end; (e) a breech disposed proximate to the proximal end of the barrel; (f) a primary reservoir capable of retaining projectiles; (g) a conveyance mechanism capable of delivering projectiles from the primary reservoir to the breech; and (h) a firing mechanism capable of delivering discrete bursts of compressed gas to the breech and thereby firing projectiles from the barrel.

The primary reservoir is at least about 80% disposed within the stock section, the central section, the barrel section, an appendage disposed below the stock section, disposed below the central section, disposed below the barrel section, or combinations thereof. The conveyance mechanism can deliver projectiles to the breech at a rate greater than about 300 per minute and the firing mechanism is capable of firing projectiles at a rate greater than about 300 per minute.

Preferably, projectiles retained within the primary reservoir and in the conveyance mechanism are at atmospheric pressure without other external force on the projectiles.

The gun can further comprise an appendage disposed below the central section, wherein the conveyance mechanism is disposed within the appendage, and wherein the primary reservoir is disposed within the first appendage. The appendage can be a clip attached to the central section such that the clip can be detached and re-attached without use of tools.

The gun can further comprise a forestock section disposed below the barrel section, wherein the forestock section includes a secondary reservoir for retaining projectiles. The forestock section can be attached to the barrel section such that it can be detached and re-attached without use of tools. Preferably, the forestock section and the appendage are in communication, whereby the secondary reservoir can provide projectiles to the primary reservoir. In such an embodiment, projectiles are delivered to the breach via the conveyance mechanism in the appendage, and projectiles are delivered from the secondary reservoir to the primary reservoir by the operation of gravity.

Preferably, the conveyance mechanism comprises: (a) a revolving conveyer belt sized and dimensioned to retain one or more projectiles, and (b) a drive mechanism for revolving the conveyer belt. The drive mechanism is powered by the firing mechanism of the gun for driving the conveyer belt.

The firing mechanism comprises: (a) a bolt disposed within the central section rearward of the barrel, the bolt having a forward end, a rearward, and a central bore having a longitudinal axis which is coaxial with the longitudinal axis of the barrel; (b) a hammer slidably disposed within the central section immediately rearward of the bolt, the hammer having a forward end, a rearward end and a central bore, the central bore having a longitudinal axis which is coaxial with the central bore of the barrel; (c) cocking means for attaching the hammer to the bolt; (d) trigger means for detaching the hammer from the bolt; (e) a source of pressurized gas disposed within the central section; (f) a valve for releasing a discrete burst of pressurized gas from the source to the breech and thereby firing projectiles through the central bore of the barrel; (g) gas release actuation means responsive to the hammer for actuating the valve and releasing a discrete burst of gas; and (h) spring means for urging the hammer away from the bolt and into contact with the gas release actuation means.

Preferably, the firing mechanism further comprises a piston assembly disposed in the central section for automatically cocking the gun, the piston assembly comprising: (a) a hollow sleeve having an open end and a closed end, a first aperture formed in the sleeve proximate the closed end, and a second aperture formed in the sleeve proximate the open end, wherein the first and the second apertures are sized to receive a flow of gas redirected to the apertures in sequence; (b) a piston slidably disposed within the sleeve in between the apertures; and (c) a connecting arm having a first end and a second end, the first end being connected to the piston, and the second end extending out of the second open end of the sleeve and being in communication with the bolt, wherein the open end of the sleeve is sized to snugly fit around the connecting arm while allowing the connecting arm to slide through the open end.

Preferably, the firing mechanism further comprises a cycle valve for redirecting flow of pressurized gas in the firing mechanism for firing projectiles, wherein the cycle valve comprises: (a) a spool piston comprising: (i) first and second planar disks each having an upper an a lower face and a thickness separating the faces, wherein the disks are substantially of the same size; and (ii) a connecting member having a diameter less than that of the disks, a length, and first and second ends, the connecting member being disposed between the first and second disks, wherein the first end of the connecting member is attached to the lower face of the first disk, and the second end of the connecting member is attached to the upper face of the second disk, whereby the first and second disks are disposed parallel to one another and perpendicular to the length of the connecting member; (b) a sleeve sized to receive and slidably retain the piston, the sleeve comprising: (i) a wall having first and second ends; and (ii) first and second set of apertures formed in said wall proximate said first and second ends, respectively, each set of apertures comprising a plurality of apertures radially disposed in said wall in a plane perpendicular to said wall, the apertures being spaced such that the distance between the first and second set of apertures is substantially equal to the sum of the length of the connecting member and the thickness of either of said disks.

The firing mechanism can further comprise a firing mode selection mechanism for safe, semi-automatic and fully automatic firing modes.

DRAWINGS

These and other features, aspects and advantages of the present invention will become understood with reference to the following description, appended claims and accompanying drawings, wherein:

DESCRIPTION

Figure 1:
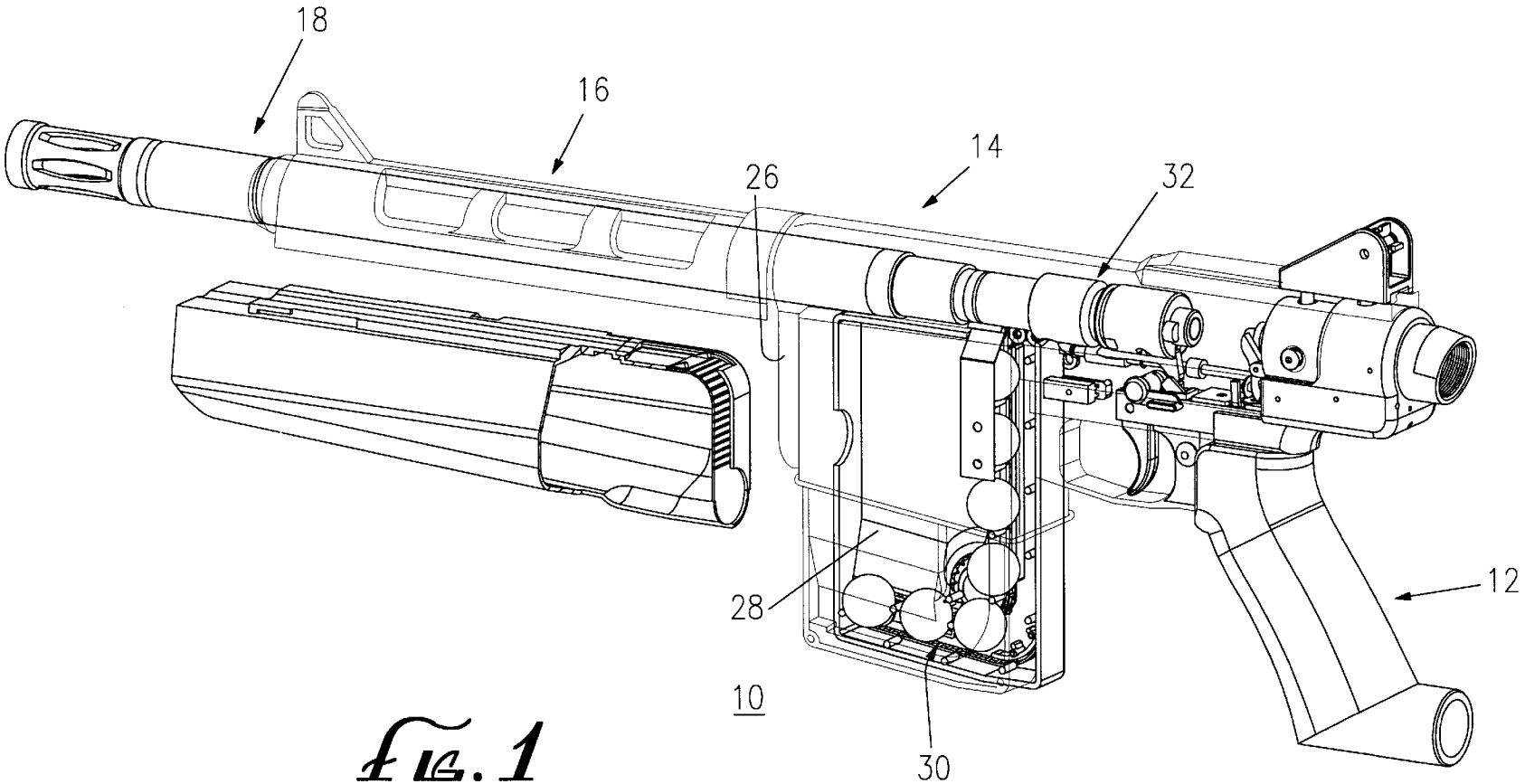
FIG. 1 is a perspective view of the gas powered repeating gun of the present invention with partial cutout sections.

Referring to the drawings, a preferred embodiment of a gas powered repeating gun 10 capable of firing projectiles with compressed gas according to the present invention is described. In this embodiment, the gun 10 comprises: (a) a stock section 12; (b) a central section 14 attached to the stock section 12; (c) a barrel section 16 attached to the central section 14; (d) a barrel 18 disposed within the barrel section 16, the barrel 18 having a longitudinal axis, a central bore 20, a proximal end 22 and a distal end 24; (e) a breech 26 disposed proximate the proximal end 22 of the barrel 18; (f) a primary reservoir 28 capable of retaining at least about 50 projectiles, the reservoir being at least 80% disposed within the central section 14; (g) a conveyance mechanism 30 capable of delivering projectiles from the primary reservoir 28 to the breech 26 at a rate greater than about 300 per minute; and (h) a firing mechanism 32 capable of delivering discrete bursts of compressed gas to the breech 26 and thereby firing projectiles at a rate greater than about 300 per minute.

The stock section 12 can be of any shape suitable for gripping by a user. It can have a longitudinal axis substantially parallel with or transverse to that of the central section 14. The stock section 12 can be made out of any suitable material, including metals, plastics and woods.

Preferably, the gun 10 can further comprise an appendage 34 disposed below and attached to the central section 14 forward of the stock section 12. In this embodiment, the primary reservoir 28 and the conveyance mechanism 30 are disposed within the appendage 34. The appendage 34 is attached to the gun 10 such that the appendage 34 can be detached and re-attached without use of tools. As such, the appendage 34 can be quickly detached and replaced with another appendage as desired. Similarly, because the conveyance mechanism 30 is disposed within the appendage 34, the conveyance mechanism 30 can be easily detached from the gun 10. Although in the embodiment shown in the drawings the primary reservoir 28 and the conveyance mechanism 30 are both disposed within the appendage 34, the present invention contemplates embodiments of the gun 10 in which the primary reservoir 28 and the conveyance mechanism 30 are separately attached to the gun 10 whereby either or both may be attached or re-attached. Further, the conveyance mechanism 30 can also be a permanent part of the gun 10 where it cannot be detached from the gun 10 without use of tools. The appendage 34 can be of any desired shape, but preferably it is rectangular and emulates ammunition clips of real guns in dimension and appearance.

As shown in FIG. 1, the gun 10 can further comprise a forestock section 36 disposed below the barrel section 16, wherein the forestock section 36 can include a secondary reservoir 37 for retaining projectiles. In the embodiment shown in the drawings, both the forestock section 36 and the appendage 34 are shaped similar to magazines and clips used in real guns such that the gun 10 of the present invention has a "gun like" appearance. Preferably, the forestock section 36 is attached to the barrel section 16 such that it can be detached and re-attached without use of tools. In this manner, once the supply of projectiles in the forestock section 36 is exhausted, the user can simply and quickly detach the forestock section 36 from the gun 10 and replace it with another forestock section 36 as necessary. Preferably, the forestock section 36 is in communication with the appendage 34 through openings 40 and 38 in the forestock section 36 and the appendage 34, respectively, whereby the secondary reservoir can provide projectiles to the primary reservoir 28. The projectiles are delivered from the secondary reservoir to the primary reservoir 28 by the operation of gravity, and thereafter delivered to the breech 26 via the conveyance mechanism 30.

Figure 2:
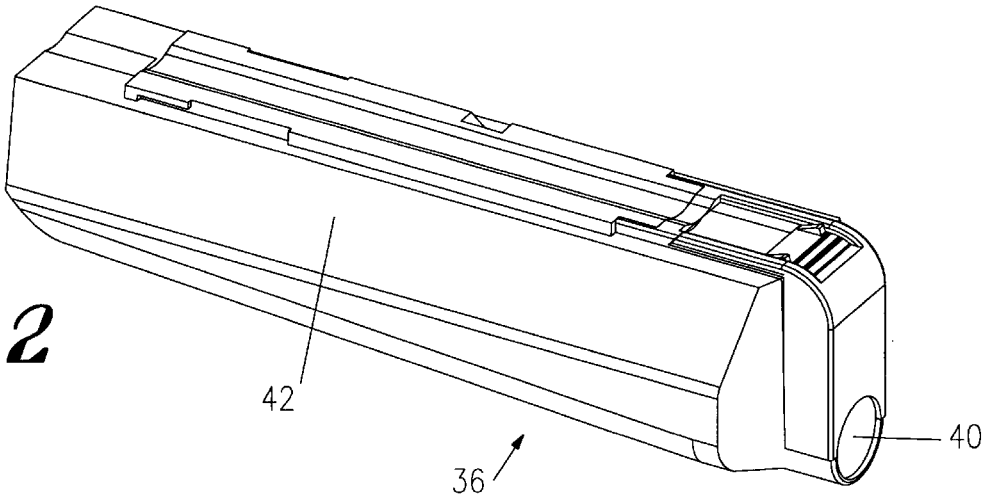
FIG. 2 is a perspective view of the forestock section of the gun of FIG. 1.

Referring to FIG. 2, a perspective view of the forestock section 36 of the gun 10 is shown. The forestock section 36 is shaped such that it is comfortable to hold while manipulating the gun 10, and emulates the look and feel of a forward rifle or paramilitary stock. The forestock section 36 can be made out of any suitable material, including metals, plastics and woods.

Figure 3:
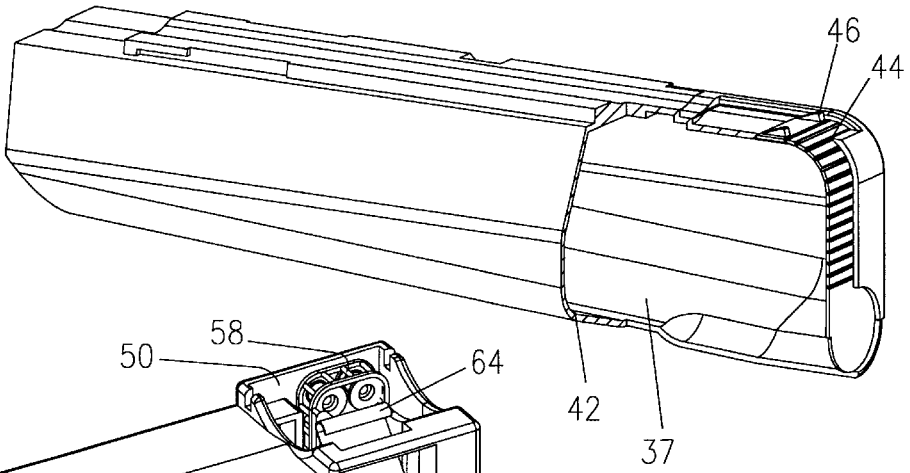
FIG. 3 is another perspective view of the forestock section of FIG. 1 with a partial cutout section.

Referring to FIG. 3, a partial cross-section of the forestock section 36 is shown. The forestock section 36 comprises a hollow shell 42 to retain projectiles as a secondary reservoir. The opening 40 in the forestock section 36 allows projectiles to travel to the primary reservoir 28 in the appendage 34 by the operation of gravity. Preferably, the forestock section 36 is shaped such that the bottom of the shell 42 is inclined in order to assist rolling of the projectiles towards the opening 40 of the forestock section 36. The forestock section 36 can further comprise a loader gate 44 under spring tension such that the gate 44 obstructs the opening 40 in the shell 42 when the forestock section 36 is not attached to the gun 10. The loader gate 44 is slidably carried in tracks in the forestock section shell 42 and includes tabs 46 on an upper portion of the loader gate 44. When the forestock section 36 is attached to the gun 10, corresponding tabs (not shown) under the barrel section 16 of the gun 10 engage the tabs 46 on the loader gate 44, sliding the gate 44 in the tracks from a closed position to an open position, thereby allowing projectiles to roll freely into the primary reservoir 28 through the forestock section opening 40. Although a loader gate 44 has been utilized in this embodiment of the forestock section 36, practitioners in the art recognize that many other forms of gates such as a spring tensioned door hinged to the forestock section shell 42, can also be used.

When the forestock section 36 is attached to the barrel section 16 of the gun 10, the loader gate 44 is in the fully open position such that the opening 40 is not obstructed. When the forestock section 36 is detached the loader gate 44 is urged to the closed position under the action of springs to prevent projectiles from exiting through the opening 40. This provides for a self-opening and self-closing of the loader gate 44.

Figure 4:
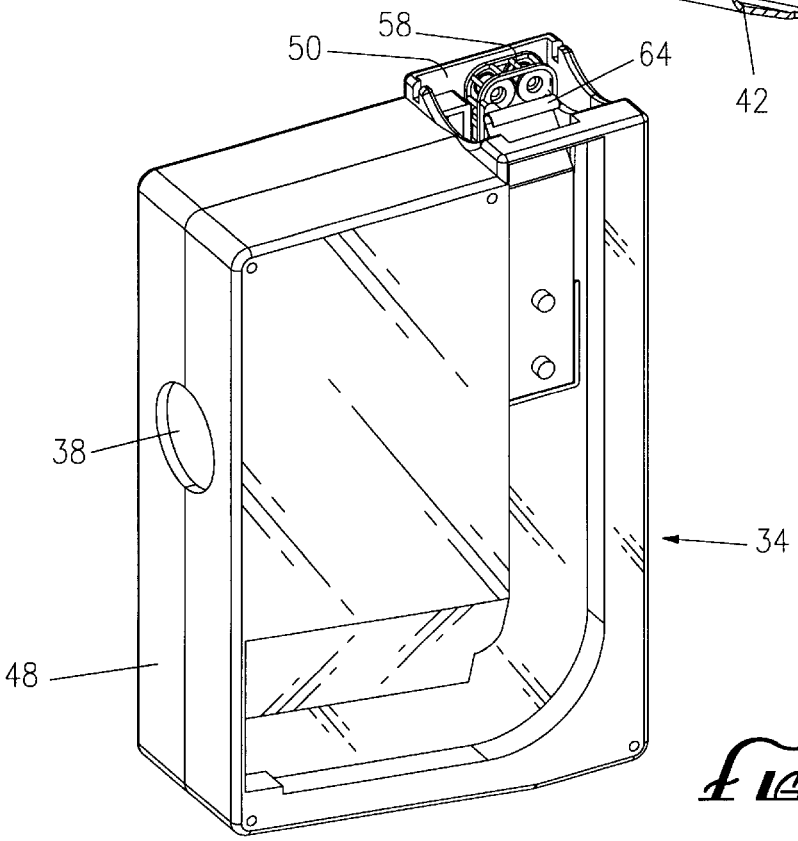
FIG. 4 is a perspective view of the appendage of the gun of FIG. 1.

Referring to FIG. 4, a perspective view of the appendage 34 is shown. Preferably the appendage 34 is sized and shaped such that it emulates the look and feel of a clip for real rifles. The appendage 34 comprises a hollow shell 48 with an opening for receiving projectiles from the secondary reservoir in the forestock section 36. The appendage 34 further comprises an outlet 50 for delivering projectiles to the breech 26 in the gun 10.

Figure 5:
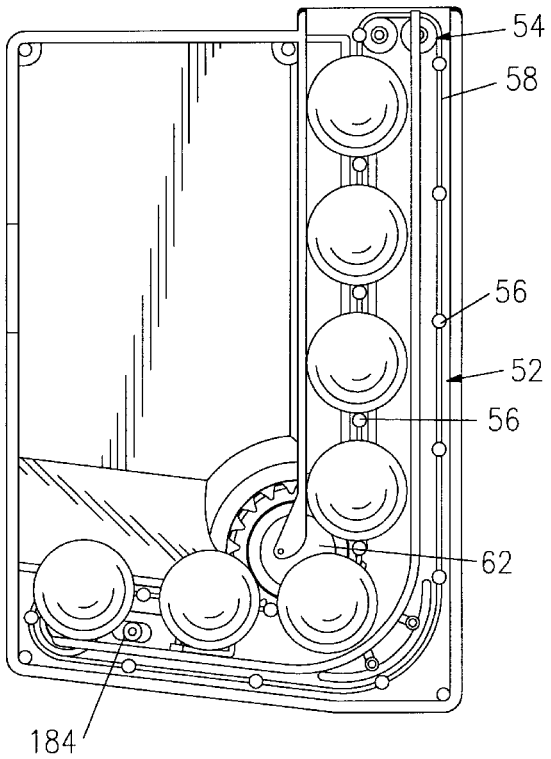
FIG. 5 is a detailed view in partial cross-section of the appendage of FIG. 4.

Referring to FIG. 5, a detailed cross-section of the appendage 34 is shown. In this embodiment, the appendage 34 houses the primary reservoir 28 and the conveyance mechanism 30 as shown. Projectiles stored in the primary reservoir 28 are delivered to the breach via the outlet 50 by the conveyance mechanism 30. Advantageously, the projectiles in the primary reservoir 28 and in the conveyance mechanism 30 are at atmospheric pressure without use of any springs or compression mechanisms to exert external pressure on the projectiles. The projectiles are allowed to loosely fill and align themselves in the primary reservoir 28. The primary reservoir 28 feeds projectiles to the conveyance mechanism 30 via gravity, whereby projectiles are allowed to drop into the conveyance mechanism 30 for transport. Alternatively, the primary reservoir 28 can be within the stock section 12, or another appendage 34 disposed below the central section 14, the barrel section 16 or the stock section 12.

As shown in FIG. 5, the conveyance mechanism comprises a revolving conveyer belt 52 sized and dimensioned to retain one or more projectiles, and a drive mechanism 54 for revolving the conveyer belt 52. The conveyer belt 52 includes a plurality of conveyer lugs 56 spaced on the conveyer belt 52 to receive and loosely retain projectiles. The projectiles in the primary reservoir 28 drop in between the lugs 56 and align themselves with the lugs 56. In the embodiment shown in FIG. 5, when the conveyer belt 52 rotates clockwise, the projectiles are delivered to the outlet 50 where they are urged out of the appendage 34 via the outlet 50. Advantageously, the conveyer mechanism is entirely self-contained within the appendage 34 and occupies minimal space so that the primary reservoir 28 can utilize this space for retaining projectiles. The conveyer belt 52 is laid out in the shape of a "L" whereby projectiles are transported to the breech 26 in the "L" shape track while the return portion of the conveyer belt 52 rides in parallel on the outside of the "L" thereby occupying minimal space.

The conveyance mechanism 30 is especially suited for transporting fragile projectiles, such as paint balls, because paint balls fit in between the conveyer lugs 56 loosely. This allows paint balls to be transported and indexed in rapid succession and fired violently through the barrel 18 at a rate of about 10–12 per second without any damage or rupturing of the paint balls. The lugs 56 are cushioned in order to minimize impact on the paint balls by a start and stop action of the conveyer belt 52 as it transports the paint balls to the breech 26. Upon a sudden starting motion of the conveyer belt 52, the cushioning of the lugs 56 allows them to deflect in order to more gently transfer the inertial motion of the conveyer belt 52 to the paint balls such that they are not ruptured. Similarly, upon sudden stopping of the conveyer belt 52, paint balls are allowed to slowly decelerate by coming into contact and deflecting each lug forward of each respective paint ball.

As shown in FIG. 4, the drive mechanism 54 of the conveyer belt 52 comprises a conveyer chain 58 for rotating the conveyer belt 52. The conveyer chain 58 is rotated by a drive cog assembly 60 powered by the firing mechanism 32 of the gun 10 whereby the firing mechanism 32 transmits successive motive force to the conveyer chain 58 via the drive cog assembly 60 for revolving the conveyer belt 52. Preferably, the cantilevered lugs 56 are mounted on the conveyer chain 58 at six link intervals. As the conveyer belt 52 rotates exact chain indexing is insured by means of detentes disposed 120° apart on an indexer 62. Further, a proper tension for the conveyer belt 52 is obtained by means of a tensioner assembly 53 as shown in FIG. 5.

As shown in FIG. 4, the appendage 34 further comprises a spring guide 64 disposed on the appendage 34 such that when the conveyance mechanism 30 transports a projectile upward into the breach, the projectile overcomes a slight force exerted sideways on the projectile by the spring guide 64. As the projectile travels above a center line relationship between the projectile and the spring guide 64, the spring guide 64 is urged inward by means of its own spring tension to insure the center line location of the paint ball in the breech 26, whereby the paint ball rests on the top portion of the relaxed spring guide 64 in preparation for firing. Preferably, the upward motion of the paint ball as it enters the breach is gently decelerated by means of a resilient cushion mounted into an upper portion of the breach.

Figure 6:
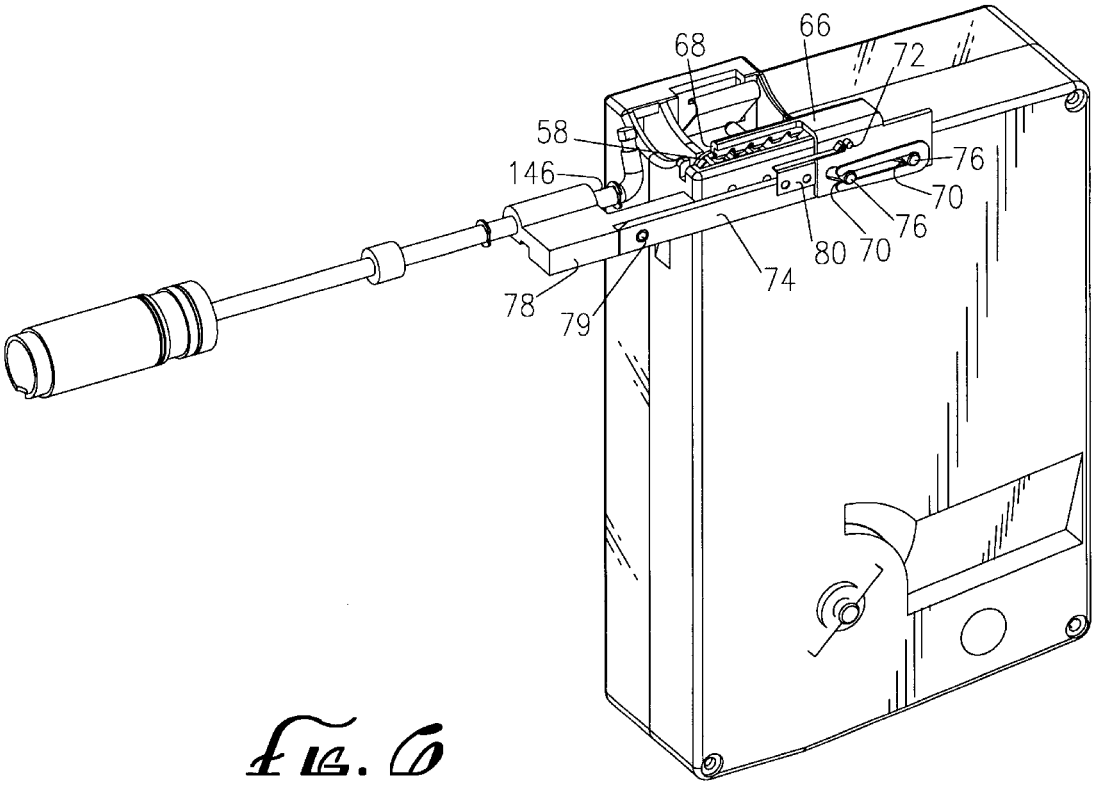
FIG. 6 is a detailed view of the conveyer drive cog assembly of the gun of FIG. 1.

Referring to FIG. 6, a perspective view of the drive cog assembly 60 of the gun 10 for rotating the conveyer chain 58 of the conveyer mechanism is shown. The drive cog assembly 60 comprises a cog 66 having teeth 68 corresponding to the conveyer chain 58, the cog 66 having a pair of angled cam slots 70 and a cog pin 72 as shown. The drive cog assembly 60 further comprises a cog pull 74 having a pair of protruding pins 76 disposed in the cam slots 70 of the cog 66, and a coupling pin 79 for attaching the cog pull 74 to a coupling 78 propelled in a cyclic forward and backward motion by the firing mechanism 32 of the gun 10. The drive cog assembly 60 further comprises a guide leaf 80 disposed in the gun 10 separate from the cog pull 74 and the cog 66 such that the guide leaf 80 remains stationery relative to the motion of the cog pull 74 and the cog 66.

In operation, when the cog pull 74 travels rearward by the rearward motion of the coupling 78, it causes the cog 66 to first travel in a downward motion relative to the guide leaf 80 because the cog 66 is prevented from traveling rearward by obstruction of the cog pin 72 by the guide leaf 80. As such, the protruding pins 76 of the cog pull 74 interact with the cam slots 70 of the cog 66 to cause a downward motion of the cog until the cog 66 reaches a point at which the cog pin 72 is no longer obstructed by the guide leaf 80 and the protruding pins 76 of cog pull 74 reach the end of cam stroke of cam slots 70 of the cog 66. In this position, the cog 66 engages the conveyer chain 58, wherein continued rearward motion of the cog pull 74 and the cog 66 rotate the conveyer belt 52, thereby urging a projectile out of the appendage 34 into the breech 26 of the gun 10 without hard contact with any surfaces. As the cog pull 74 begins its forward motion the cam guide slots 70 of the cog 66 are free to disengage from the protruding pins 76 of the cog pull 74 which allow the cog 66 to travel upward and disengage the conveyer chain 58 thereafter travel forward freely. As the cog pull 74 and the cog 66 move, the cog pin 72 rides over the guide leaf 80 until the cog pin 72 reaches a looped end portion of the guide leaf 80 where the guide leaf 80 deflects downward by force of the cog pin 72 until the cog pin 72 travels forward to a point allowing the forward portion of the guide leaf 80 to spring back upward and thus completing one cycle in loading the gun 10 with a projectile.

Figure 7:
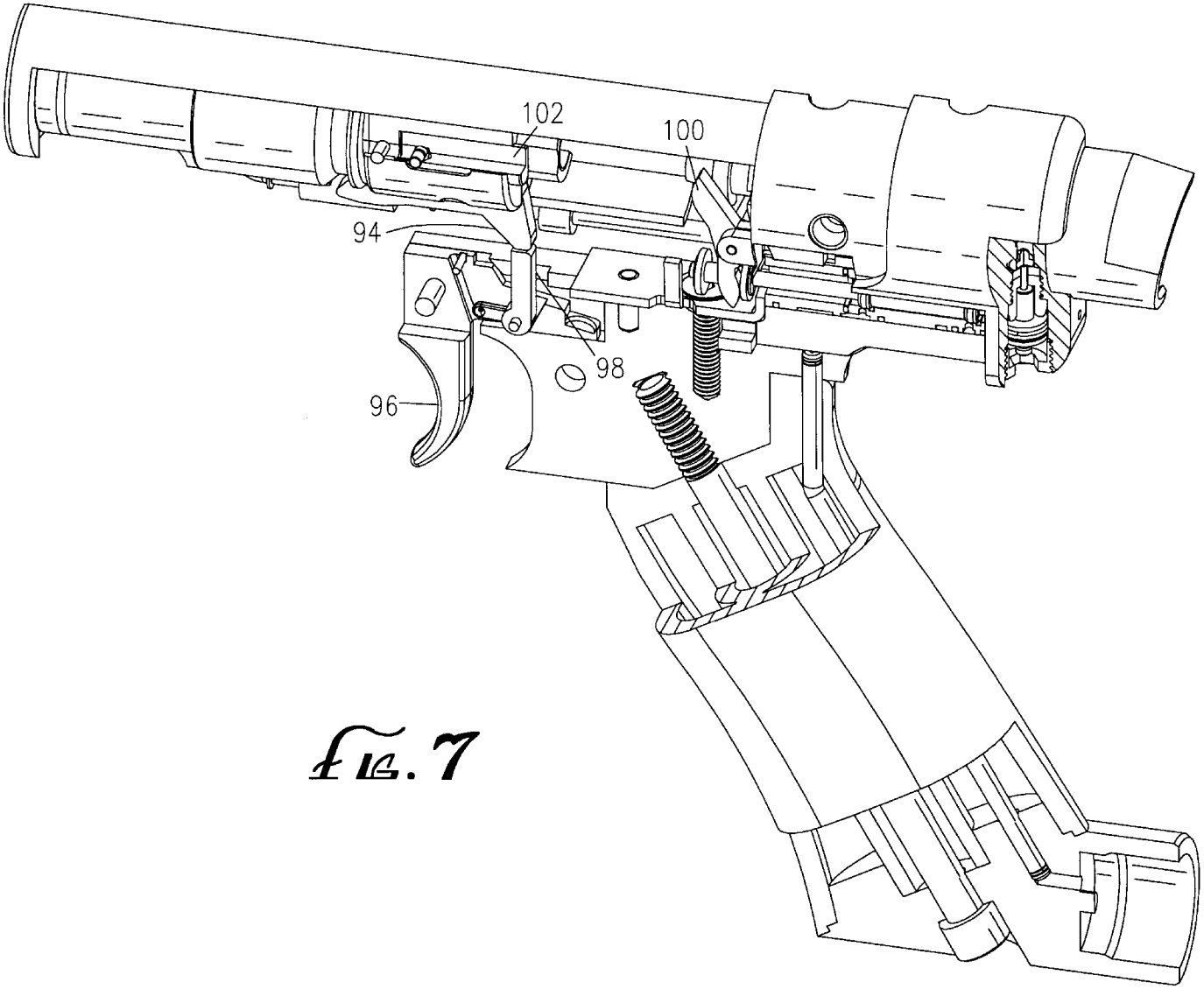
FIG. 7 is a partial detailed perspective view of the firing mechanism of the gun of FIG. 1.
Figure 8:
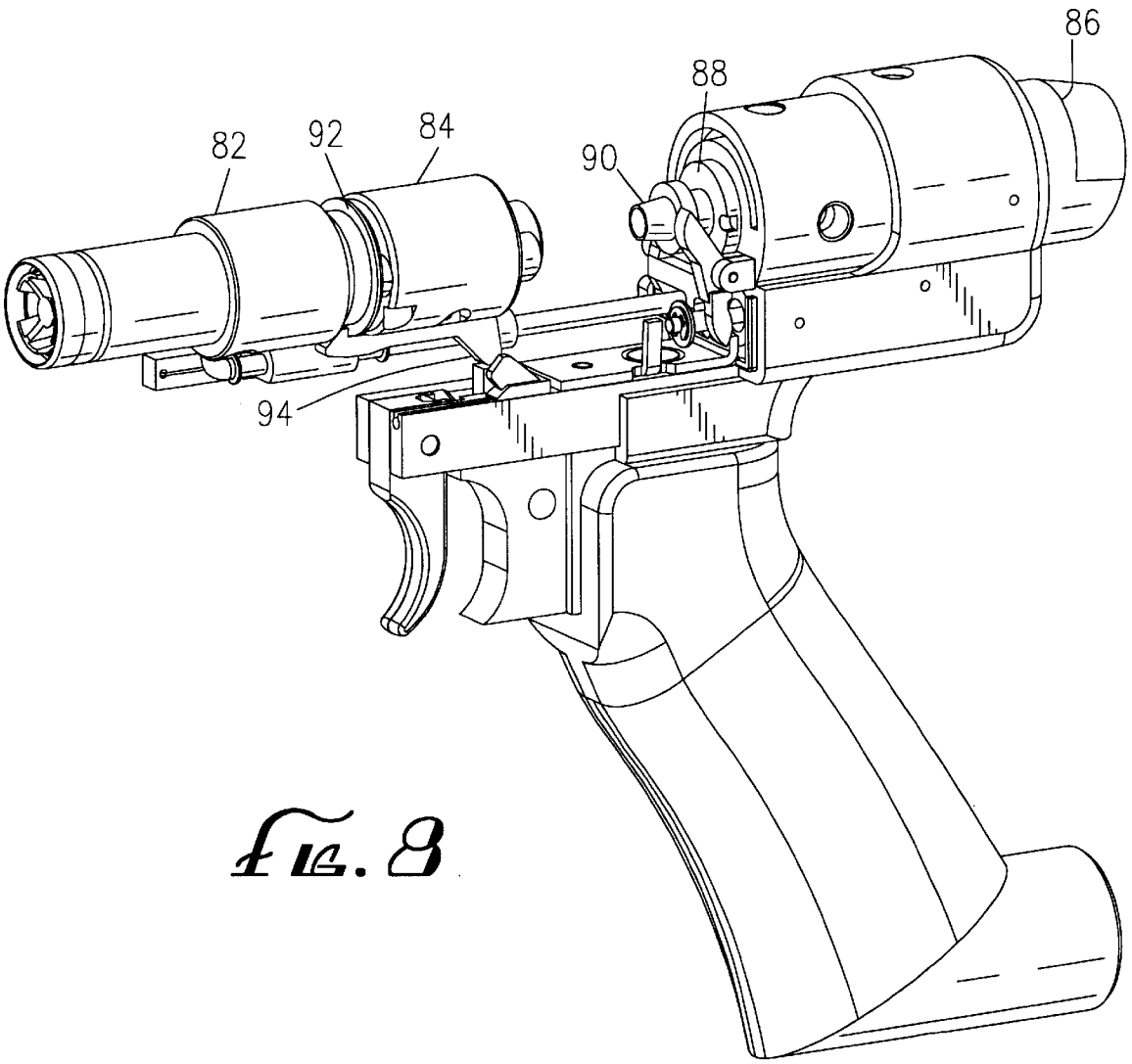
FIG. 8 is another partial detailed perspective view of the firing mechanism of the gun of FIG. 1.

Referring to FIGS. 7 and 8, an embodiment of the firing mechanism 32 of the gun 10 according to the present invention is shown. The firing mechanism 32 comprises: (a) a bolt 82 disposed within the central section 14 rearward of the barrel 18, the bolt 82 having a forward end, a rearward end, and a central bore having a longitudinal axis which is coaxial with the longitudinal axis of the barrel 18; (b) a hammer 84 slideably disposed within the central section 14 immediately rearward of the bolt 82, the hammer 84 having a forward end, a rearward end and a central bore, the central bore having a longitudinal axis which is coaxial with the central bore 20 of the barrel 18; (c) a cocking means for attaching the hammer 84 to the bolt 82; (d) trigger means for detaching the hammer 84 from the bolt 82; (e) a source 86 of pressurized gas disposed within the central section 14; (f) a valve 88 for releasing a discrete burst of pressurized gas from the source 86 to the breech 26 and thereby firing projectiles through the central bore 20 of the barrel 18; (g) gas release actuation means 90 responsive to the hammer 84 for actuating the valve 88 and releasing a discreet burst of gas; and (h) spring means 92 for urging the hammer 84 away from the bolt 82 and into contact with the gas release actuation means 90.

The bolt 82 can be made of any suitable material, such as plastic or like metal. The hammer 84 can be made of any suitable material having sufficient mass to actuate the gas release actuation means 90 described below and must be made of a material strong enough to withstand the mechanical and pressure forces generated during operation. In a typical embodiment, the hammer 84 is made out of a metal, such as steel.

The cocking means in the embodiment shown in the drawings comprises a sear 94 which is swivably attached to the hammer 84 by a sear pivot. The sear 94 has a latch which is adapted to engage a notch defined by the exterior surface of the rearward end of the bolt 82. When the latch is engaged within the notch, the bolt 82 is held firmly in close proximity to the hammer 84. The sear 94 also comprises a sear cam which cooperates during the firing operation with a trigger means, described below.

The spring means 92 for urging the hammer 84 away from the bolt 82 is disposed in between the hammer 84 and the bolt 82. The spring 92 is so disposed that, when the hammer 84 is attached to the bolt 82 by the sear 94, the spring 92 is in compression. The spring 92 can be of any suitable strength. Typically, the spring 92 has a spring tension between about 3 pounds and about 12 pounds.

The trigger means for detaching the hammer 84 from the bolt 82 is a trigger 96 which is swivably attached on a trigger pivot. The trigger 96 is shaped with (1) a trigger projection for contact with the user's finger, and (2) a pawl 98 swivably attached to the trigger 96 under spring tension and disposed in close proximity to the sear cam. As can be seen in FIG. 8, when the trigger projection is pulled by the finger of a user, the pawl 98 rotates upwardly and contacts the sear cam. By this action, the sear 94 is caused to rotate about the sear pivot so as to cause the latch to disengage from the notch of the bolt 82 releasing the hammer 84.

The source 86 of pressurized gas can be a pressurized a canister within the stock section 12 or central section 14 of the gun 10. The source 86 of gas can also be external to the gun 10, but connected to the valve 88 via pipes. Preferably, the pressurized gas is any one of several inexpensive, non-corrosive gases. Carbon dioxide is most typically used as a pressurized gas. Pressurized air and pressurized nitrogen can also be used.

The valve 88 and the gas release actuation means 90 are fully described in U.S. Pat. No. 5,339,791, incorporated herein by reference. The valve 88 is affixed immediately forward of the source 86 of gas in the central section 14. The valve 88 and the valve actuation means are provided by a pressure release valve. The pressure release valve comprises a valve seat, a valve tube having at least one valve port, a sealing ring and a backing nut. In a typical embodiment, the pressure release valve has two valve ports, each being about 0.18 inches in diameter. Spring means are provided to urge the backing nut against the sealing ring to cover and seal the ports. Typically, the valve spring exerts between about 3 and about 12 pounds of force. The valve actuation means includes a valve tube disposed forward of the valve 88 wherein the gas from the gas source 86 is released through the valve tube as a rapid pulse of high pressure gas thereby ejecting a projectile through the barrel 18 of the gun 10.

As shown in FIG. 8, the firing mechanism 32 further comprises a rocker 100 slideably attached to the central section 14. A striker 102 attached to the hammer 84 comes into contact with a protruding jam portion of the rocker 100 after the projectile has left the barrel 18 of the striker 102, thereby beginning a complete cocking and loading cycle described further below.

Figure 9:
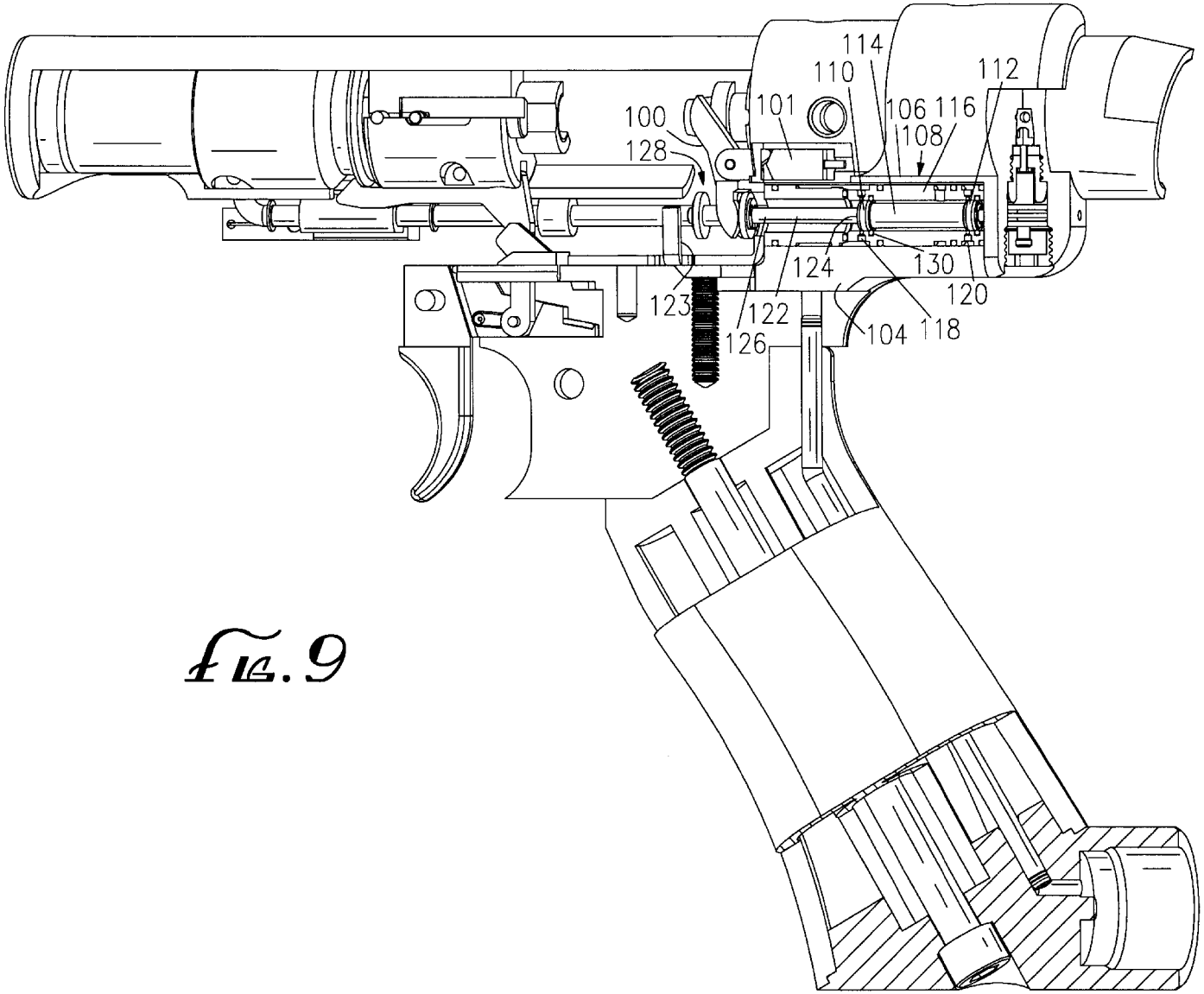
FIG. 9 is a detailed cross-section view of the cycle valve of the gun of FIG. 1.

Referring to FIG. 9, the firing mechanism 32 further includes a cycle valve 104 for redirecting flow of pressurized gas in the firing mechanism 32 for firing projectiles. The cycle valve 104 comprises a spool piston 106 and a sleeve 108 sized to receive and slideably retain the piston. The spool piston 106 comprises: (a) first and second planar disks 110, 112 each having an upper and a lower surface, and a thickness separating the faces, wherein the disks are substantially of the same size; and (b) a connecting member 114 having a diameter less than that of the disks 110, 112, a length, and first and second ends, the connecting member 114 being disposed between the first and second disks 110, 112, wherein the first end of the connecting member 114 is attached to the lower face of the first disk 110, and the second end of the connecting member 114 is attached to the upper face of the second disk 112, whereby the first and second disks are disposed parallel to one another and perpendicular to the length of the connecting member 114. The sleeve 108 comprises: (a) a wall 116 having first and second ends; and (b) first and second set of apertures 118, 120 formed in said wall 116 proximate said first and second ends, respectively. Each set of apertures comprises a pair of apertures radially disposed in said wall 116 in a plane perpendicular to said wall 116. The apertures are spaced such that the distance between the first and second pair of apertures is substantially equal to the sum of the length of the connecting member 114 and the thickness of either of said disks 110, 112.

The piston is capable of traveling through the sleeve 108 with minimum friction between the first and the second piston position relative to the first and the second set of apertures 118, 120, respectively, wherein: (1) in the first piston position gas can only flow through the first set of apertures, and (2) in the second piston position gas can only flow through the second set of apertures. The sequential redirection of gas through the first and the second pair of apertures is utilized by a piston assembly described below to cause the firing mechanism 32 to automatically cock and load the gun 10 in preparation for firing.

Advantageously, the spool piston 106 does not utilize friction seals on the piston to prevent escape of pressurized gas. The tolerances between the spool piston 106 and the sleeve 108 are minimal such that with 100 PSI of air or gas the leak rate for the valve would be limited to approximately 50 cubic centimeters of gas per minute. Because the spool valve does not utilize friction seals, the spool valve provides a reliable flow directing mechanism that can be used in almost any environment and almost any given temperature range because no friction seals are utilized.

As shown in FIG. 9, the cycle valve 104 further comprises a cycle core 122 having a first and a second end 124, 126, the first end 124 of the cycle core 122 being attached to the upper face of the first disk 110, wherein the second end 126 of the cycle core 122 is in communication with the rocker 100 via a pair of spaced of flanges 128 proximate the second end of the cycle core 122. A pair of cams protruding from the rocker 100 are slideably disposed between the flanges 128, whereby when the hammer 84 strikes the rocker 100 and rotates it, the rotation causes the protruding cams of the rocker 100 to move the cycle in a forward or rearward motion in order to redirect flow of gas through the first or second pair of apertures. As shown in FIG. 9, the sleeve 108 can further comprise a pair of circular seals 130 mounted into annular grooves on the internal surface of the sleeve 108 proximate to the first and the second pair of apertures 118, 120 and spaced to prevent pressurized gas or air contained in area A1 from escaping to atmosphere. Advantageously, the simultaneous contact of the faces of the spool piston 106 on to both seals 130, prevents escape of gas from the sleeve 108 while the spool piston 106 is at rest against the seals 130.

Figure 10:
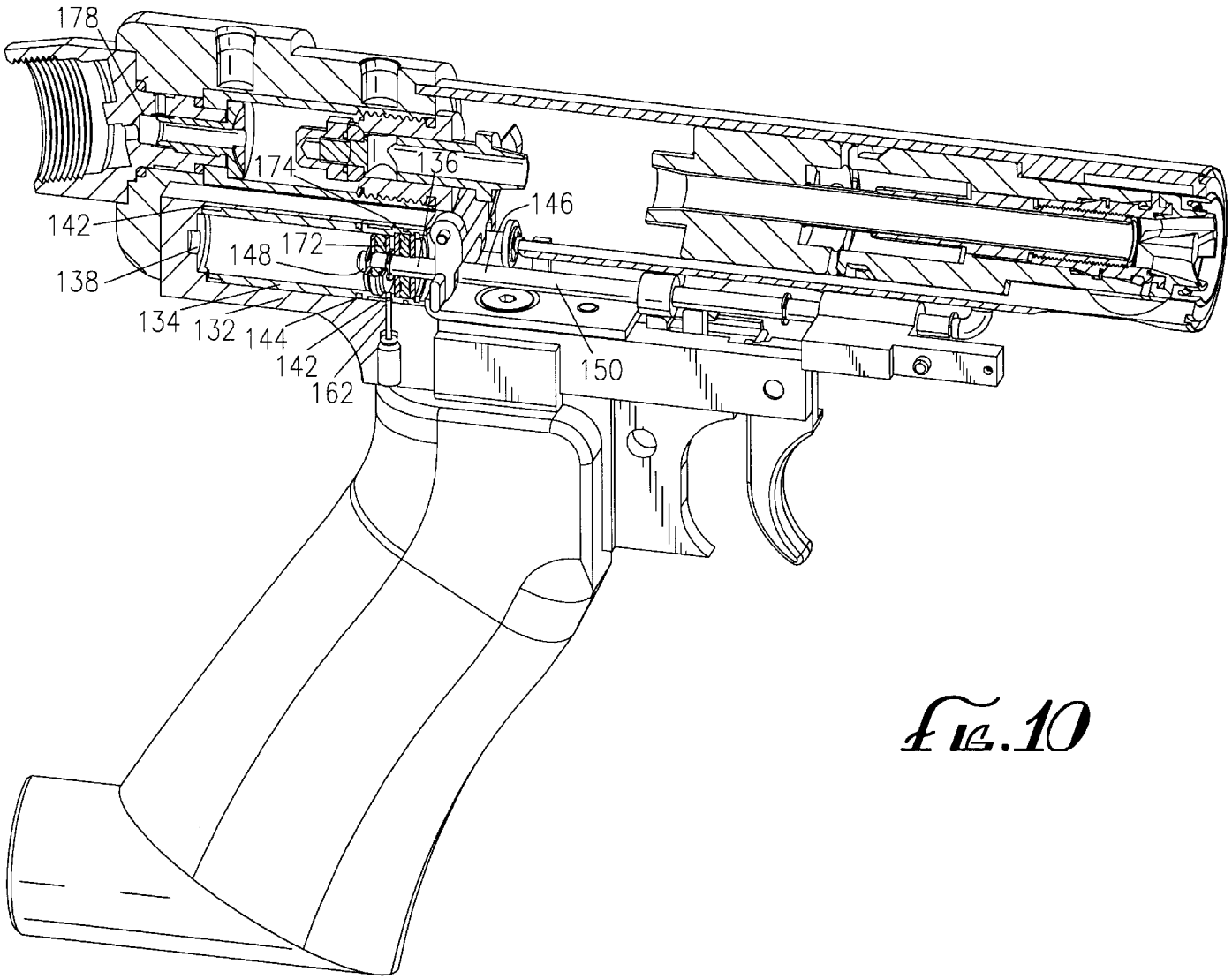
FIG. 10 is a partial cross-section view of the piston assembly of the firing mechanism of the gun of FIG. 1.

Referring to FIG. 10, the firing mechanism 32 further comprises a piston assembly 132 disposed in the central section 14 for automatically cocking the gun 10. The piston assembly 132 comprises a hollow sleeve 134 having an open end 136 and a closed end 138, a first aperture 140 formed in the sleeve 134 proximate the closed end 138 and, a second aperture 142 formed in the sleeve 134 proximate the open end 136, wherein the first and the second apertures 140, 142 are sized to receive a flow of gas from the cycle valve 104 redirected to the apertures in sequence by the cycle valve 104. The piston assembly 132 further comprises a piston 144 slideably disposed within the sleeve 134, and a connecting arm 146 having a first end 148 and a second end 150, the first end 148 being connected to the piston 144, and the second 150 end extending out of the open end 136 of the sleeve 134 and being attached to the bolt 82. The second end 150 is also attached to the coupling 78 of the drive cog assembly 60 described above in order to power the drive cog assembly 60 via the connecting arm 146. The open end 136 of the sleeve 134 is sized such that it fits snugly around the connecting arm 146, while allowing the connecting arm 146 to slide through the opening, in order to prevent gas from escaping from the sleeve 134 in between the arm and the open end 136.

The cycle valve 104 in conjunction with the piston assembly 132 operate to automatically recock and reload the gun 10 in between firing of projectiles as described below.

To start a cycle, the user urges the rocker 100 into a rotational motion which rotation is resisted by a follower 101 shown in FIG. 10. The follower 101 is an over center cam acting against a protruding cam on the rocker 100 by means of a coil compression spring and has a center peak and a cavity. Once the protruding cam on the rocker 100 rotates past the center peak of the follower 101, the follower 101 forces the rocker 100 to continue rotating until it comes to a stop point within the follower cavity. A cam protrusion on the rocker 100 will urge a flange 128 on the cycle core 122 forward whereby the cycle core 122 is urged to move until it is stopped from further forward motion by a retainer 123. Gas pressure from a low pressure side of a regulator assembly is redirected through the first pair of apertures 118 in the cycle valve 104 to the first aperture 140 of the piston assembly 132. The gas urges the piston 144 of the piston assembly 132 rearward within the piston assembly sleeve 134, whereby the connecting arm 146 of the piston assembly 132, shown in FIG. 7, urges the bolt 82 rearward toward the hammer 84, which is at rest proximate the valve 88, until the sear 94 latches over the lip of the bolt 82. Thereafter, the rearward motion of the piston 144 and the bolt 82 is reversed to forward motion by a timing collar, attached to the connecting arm 146, which comes into contact with a cam protrusion on the rocker 100 reversing the direction of the rocker 100. As the rocker 100 reverses direction and overcomes the center point of the follower 101, the rocker 100 is forced to continue rotation causing protruding cams of the rocker 100 to strike rearward on a flange 128 of the cycle core 122, thereby urging the cycle core 122 rearward to a stopped position shown in FIG. 9. Thereafter, low pressure gas from area A1 is redirected through the second pair of apertures in the cycle valve 104 to the second aperture 142 of the piston assembly 132, thereby causing the piston 144 of the piston assembly 132 to be urged forward back to its starting point. Since the piston assembly 132 is attached to the coupling 78 of the drive means, the aforementioned forward and backward motion of the piston assembly 132 powers the driving mechanism for simultaneous loading of projectiles from the primary reservoir 28 as described above. Once the simultaneous cocking and loading cycles are completed, the gun 10 is ready to fire the projectile on pulling on the trigger 96.

Figure 11:
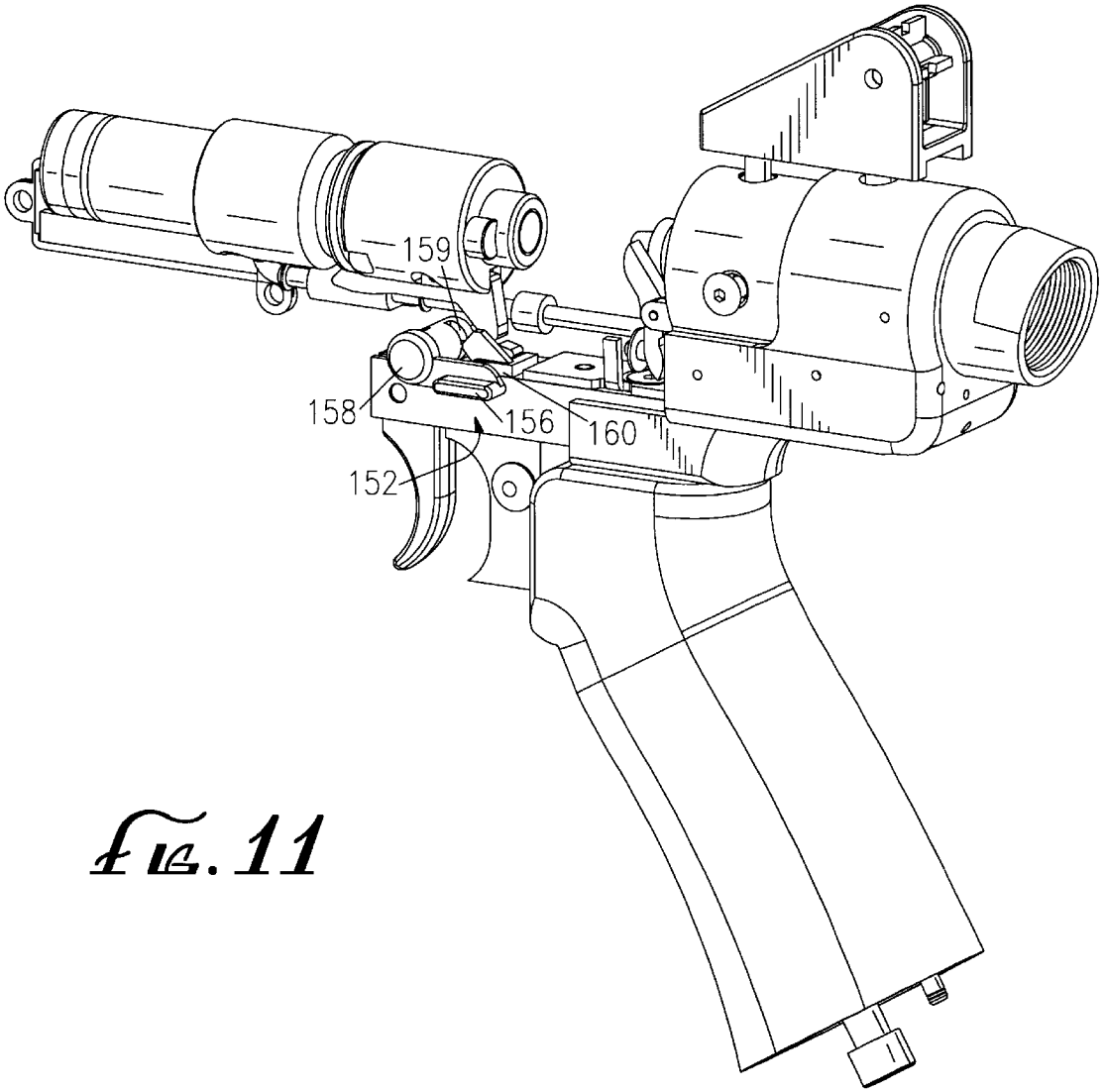
FIG. 11 is a perspective view of the firing mode selection mechanism of the present invention.

Preferably, the gun 10 further comprises a firing mode selection mechanism 152 to provide safe, semi-automatic, and fully automatic firing modes. Referring to FIG. 11, the firing mode selection mechanism 152 comprises a selector 154 having a select lever 156 attached to a selector drum 158 having mode faces 159 on its outer surface. The firing mode selection mechanism 152 further comprises a safety 160 having a forward nose, wherein the safety 160 is disposed proximate the selector.

Figure 12:
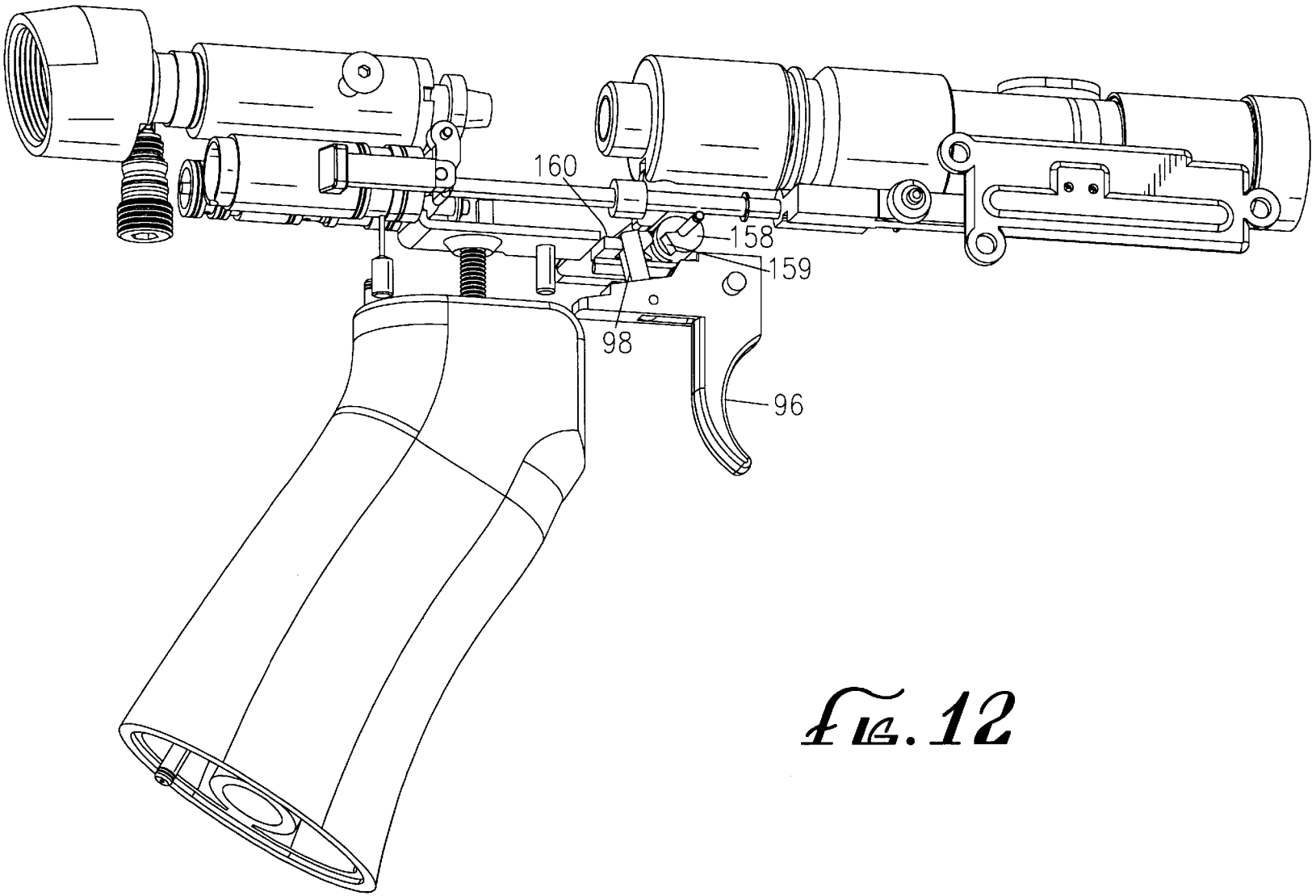
FIG. 12 is a perspective view of the firing mode selection mechanism of the present invention in the safe mode.

Referring to FIG. 12, in the safe position, the rear vertical surface of the pawl 98 rests on a protruding surface of the safety 160, so that when the trigger 96 is pulled, the pawl 98 is guided behind the sear 94, preventing the hammer 84 from disengaging from the bolt 82, thereby disabling the gun 10 from firing.

Figure 13:
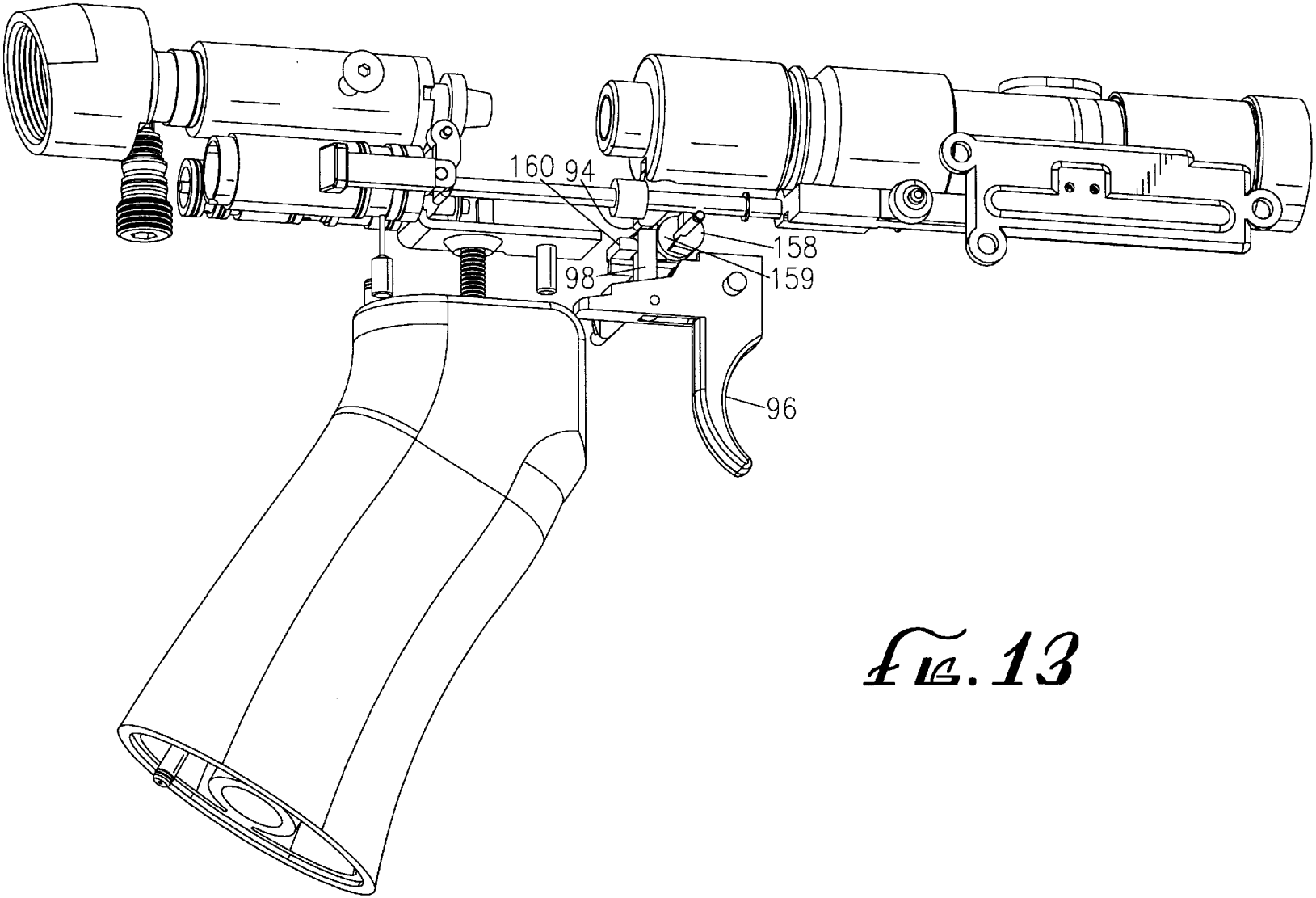
FIG. 13 is a perspective view of the firing mode selection mechanism of the present invention in the semi-automatic mode.

Referring to FIG. 13, in the semi-automatic position, the pawl 98 is positioned such that when the trigger 96 is pulled, the pawl 98 forces the sear 94 to disengage the hammer 84 from the bolt 82, thereby firing and cycling the gun 10. While the trigger 96 remains pulled, and the gun 10 has repeated one firing and loading cycle as described above, the hammer 84 travels forward, whereby a diagonal portion of the lower lobe of the sear 94, as shown in FIG. 12, comes into contact with the upper radius of the pawl 98. This causes the vertical portion of the pawl 98 to rotate into a clearance cavity area of the selector 154. Because the pawl 98 is only slightly urged rearward by means of the pawl spring, the pawl 98 does not cause the disengagement of the sear 94 from the bolt 82. The hammer 84 is prevented by other means (not shown) from traveling any further forward. As the user releases pressure on the trigger 96, the pawl 98 is free to rotate and rest against the safety 1 60, where it is ready once again to apply upward force to the sear 94, upon subsequent pulls of the trigger 96.

Figure 14:
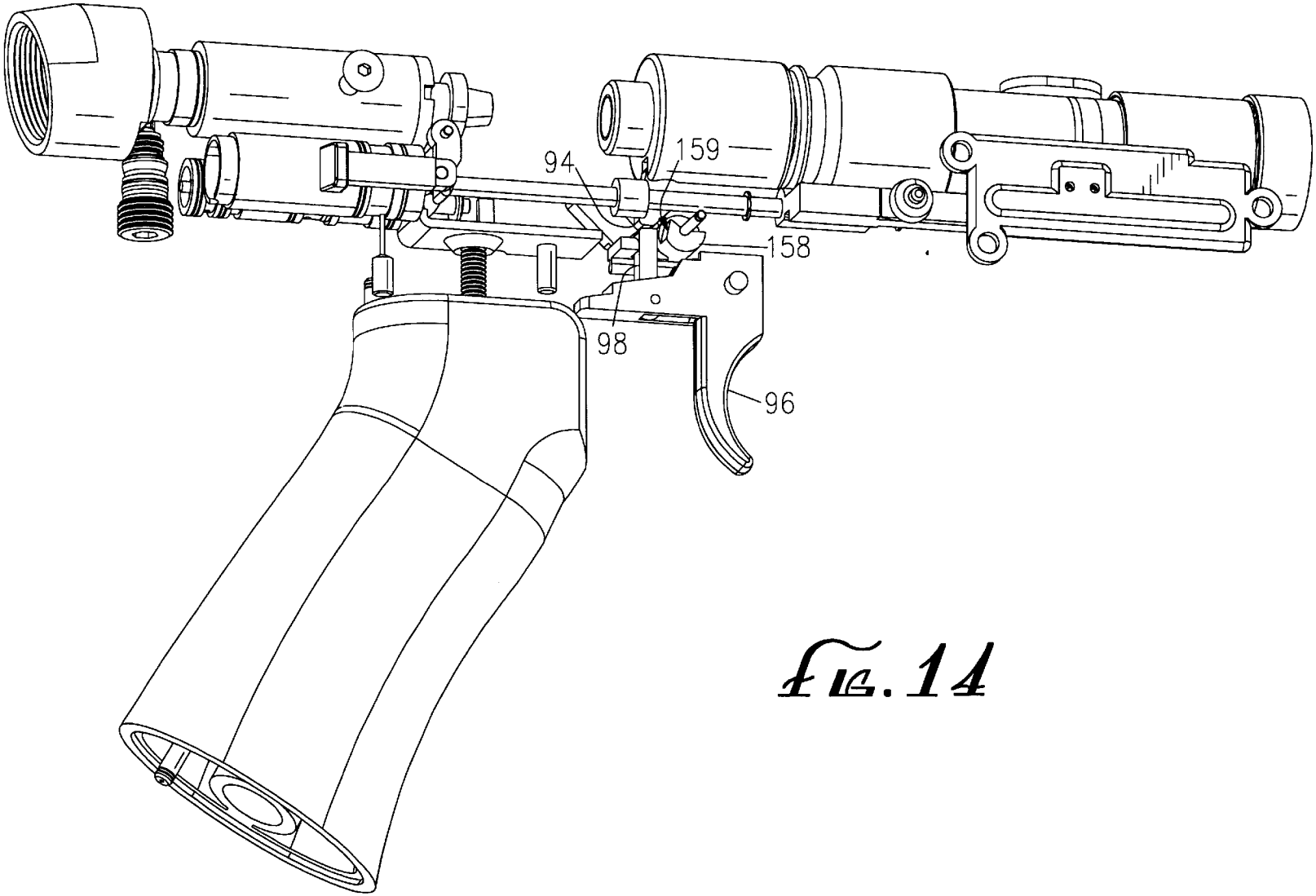
FIG. 14 is a perspective view of the firing mode selection mechanism of the present invention in the fully-automatic mode.

Referring to FIG. 14, in the fully automatic position, as the trigger remains pulled, and the hammer 84 and bolt 82 travel forward after one firing and reloading cycle, the forward diagonal portion of the lower lobe of the sear 94 will come into contact with the upper rear radius of the pawl 98. This will cause the pawl 98 to rotate forward and come into contact with a face of the selector 1 54. As the hammer 84 and the bolt 82 continue traveling forward, the lower lobe of the sear 94 is forced to rotate and disengage the hammer 84 from the bolt 82.

This cycle is repeated as long as the trigger 96 remains pulled, because in every cycle the lower lobe of the sear 94 is forced to rotate by the face of the selector 154 and disengage the hammer 84 from the bolt 82. When the trigger is released, the cycle will cease.

Another aspect of the present invention provides for cycle rate adjustment, whereby the cycle rate, or the time it takes for the piston 144 of the piston assembly 132 to travel rearward once and return forward once, can be adjusted to any desirable rate of fire or rate of single cycle by means of a flow valve, such as a flow pin 162 shown in FIG. 10. The flow of gas allowed to enter area A5 is controlled by the flow pin 162 which may be adjusted by the user to vary the cycle time by turning the flow pin 162 clockwise or counter clockwise to adjust flow into the area A5.

Figure 15:
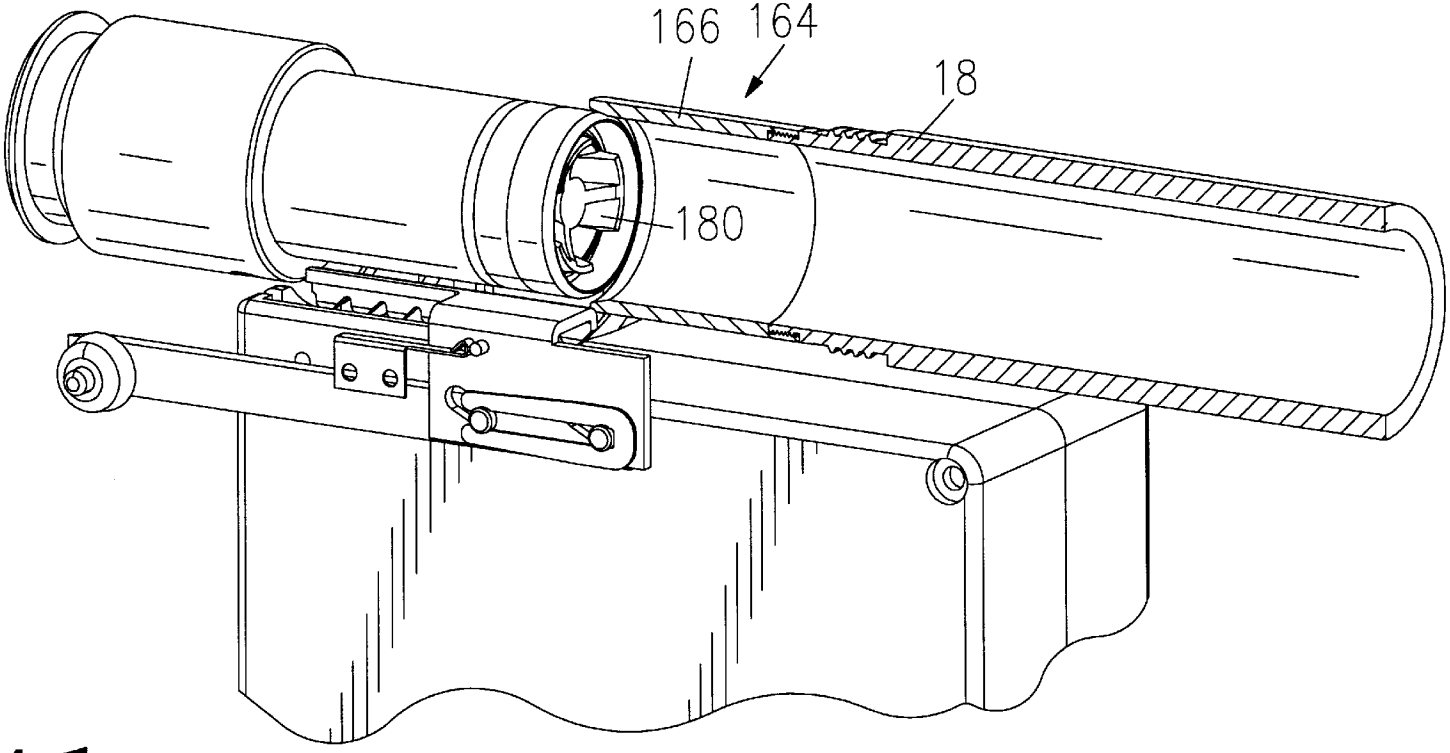
FIG. 15 is a perspective view of the breech sizer of the present invention with cut out sections.

A further aspect of the present invention is a breech sizer system 164 to adjust the size of the breech 26 to accommodate different size projectiles for proper compression consistent performance in all conditions with any size projectile. As shown in FIG. 15, the breech sizer system 164 can comprise a breech sizer sleeve 166, wherein the sleeve 166 is threaded onto the proximal end 22 of the barrel 18. Different size sleeves are utilized for different size projectiles. In this embodiment, the barrel 18 is removable and the threaded connection of the breech sizer sleeve 166 with the barrel 18 allows the sleeve 166 to be removed with the barrel 18 as an integral unit. Alternatively, the breech sleeve 166 can be disposed proximate the breech 26 of the gun 10 independent of the barrel 18, where the barrel 18 may or may not be replaceable.

Figure 16:
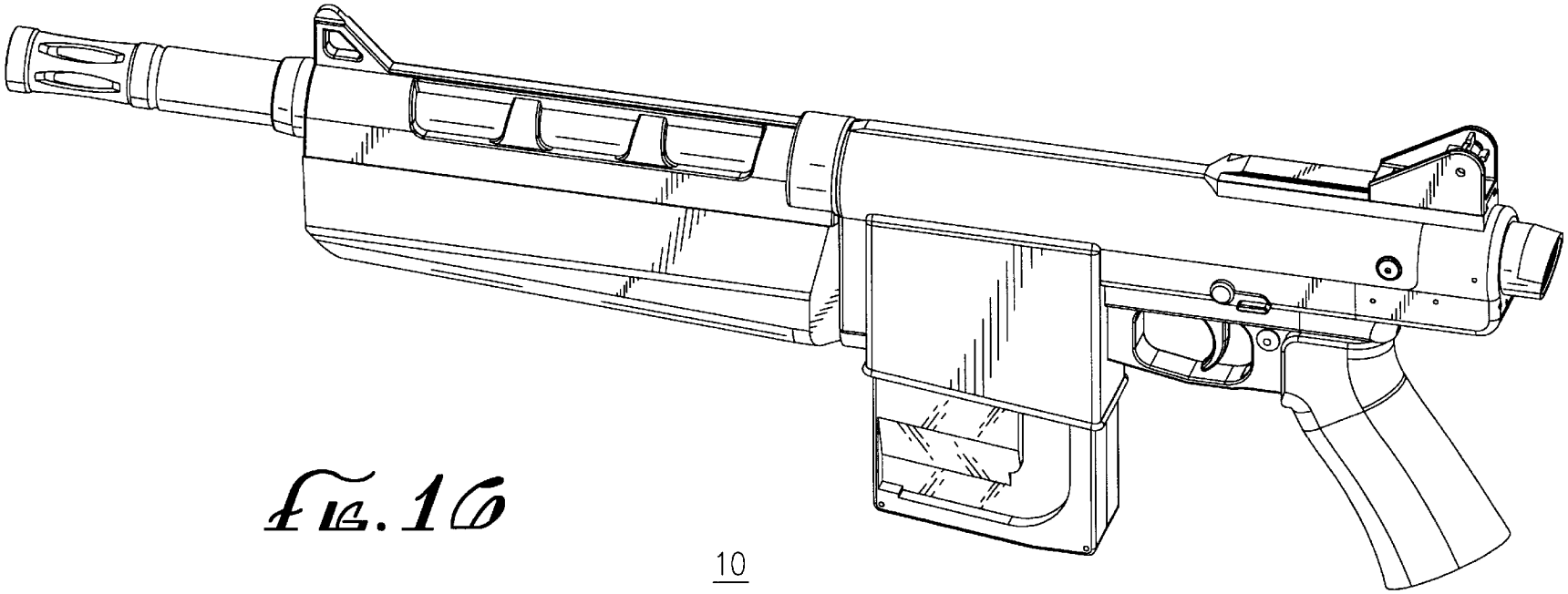
FIG. 16 is a perspective view of the gun of the present invention.

Another aspect of gun 10 the present invention is that the integration of all functional components responsible for firing, cycle motion, pressure regulation, grip, piston and cylinder movement and trigger actuation in a single module. As shown in FIG. 16, advantageously, the aforementioned components are housed completely within the module without the use of any external integration means such as plumbing or hoses.

The present invention also provides for multiple caliber adaptability to different caliber projectiles such as paint pellets by the replacement of very few components. For example, referring to FIG. 6, should it be necessary to accommodate smaller paint balls, it would also be desirable to provide a higher capacity for the smaller paint balls. This can be accomplished by: (1) providing a cog 66 with shallower teeth, (2) providing a conveyance mechanism 30 with lugs 56 spaced four to five links apart rather than six links apart, to accommodate the larger number of paint balls on the conveyer belt 52, and (3) providing a barrel 18 with a smaller caliber central bore 20 and associated breech sleeve. Due to the modular nature of the gun 10 of the present invention, other modifications to the gun 10 can be achieved by localized modifications to a single module instead of replacing the entire gun.

The invention also contemplates a feedback system to inform the user, or other systems within the gun 10, of the loading or cocking status of the gun 10. For example, referring to FIG. 4, the spring guide 64 can serve as a component of a feedback system wherein as a paint ball is transported vertically in the conveyer belt 52 and forces the spring guide 64 to one side, the side movement of the spring guide 64 can be used to inform the user or other systems within the gun 10 that a paint ball has truly entered the breech 26 and the gun 10 is loaded and prepared to fire. As another example, the movement of the spring guide 64 could serve as a feedback interrupt to a subsystem within the gun 10 that would only allow the gun 10 to function so long as a paint ball has been loaded into the breech 26. This is similar to a real gun where when the clip is empty the gun will not fire and the breech 26 will remain open until a projectile is manually loaded into it.

Yet, another example use of the feedback system would be to inform the user via a display or other visual means that a projectile is loaded into the breech 26 so that the user can exercise caution. Further, the feedback can be used for the purposes of a cycle interrupt or for actuation of a multiple shot burst system incorporated into the gun 10, whereby a predetermined number of projectiles are automatically fired from the gun 10 when the trigger remains pulled. Practitioners in the art can appreciate that the feedback system can be used to provide control for many other subcomponents of the gun 10. The present invention contemplates such control to be provided by means of hardware or software in addition to electro-mechanical means.

Figure 17:
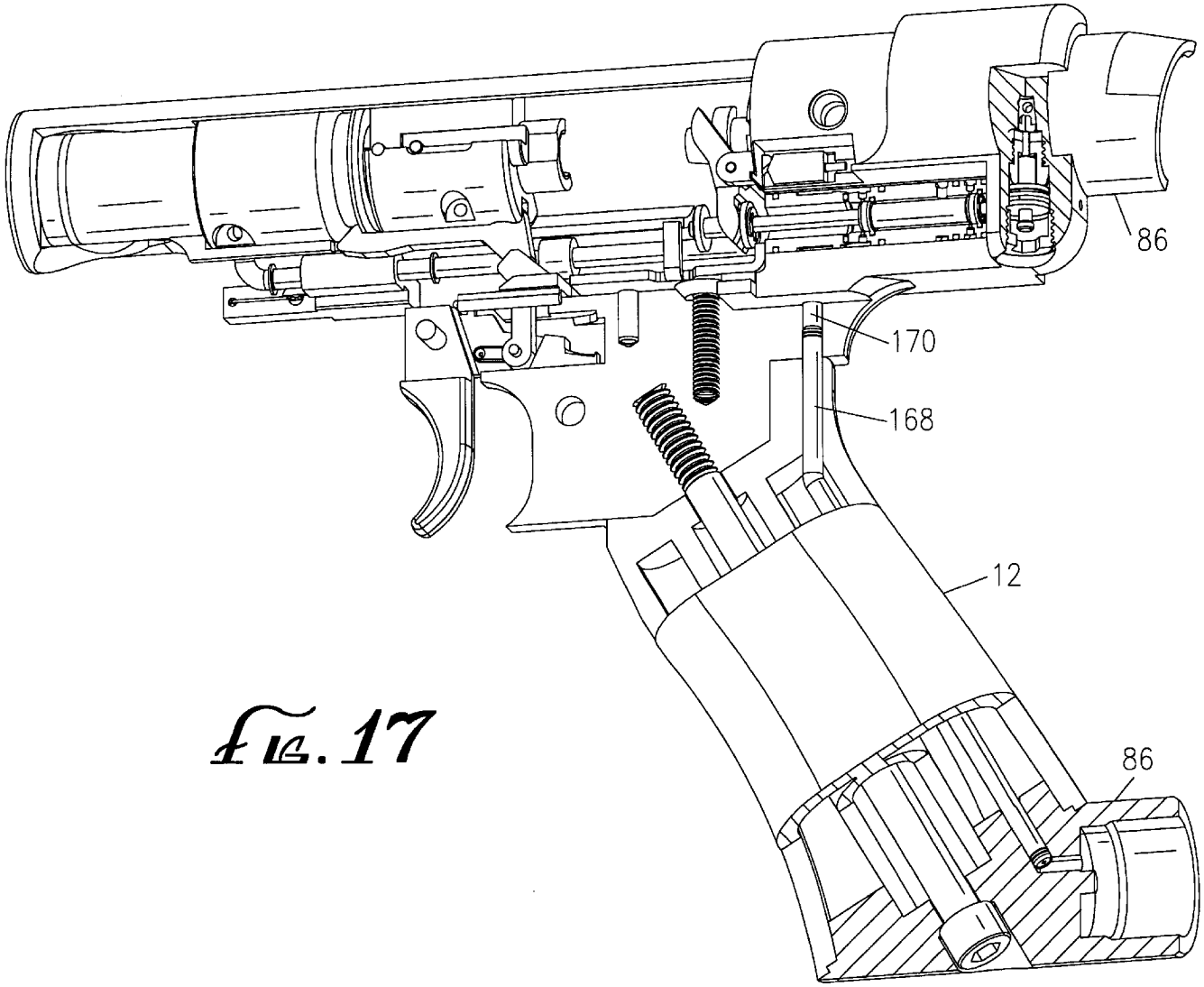
FIG. 17 is a perspective cross-section view of the central and stock sections of the present invention with multiple sources of gas.

The present invention also contemplates using a source 86 of pressurized gas, such as a canister of gas, disposed in the central section 14, or in the stock section 12. The canister can be attached such that it can be detached and re-attached without use of tools when replacing an exhausted source of gas. Referring to FIG. 17, two canisters can be utilized with the gun 10 at the same time, one disposed in the central section 14 and the other in the stock section 12. Gas from the canister in the stock section 12 is routed to the central section 14 of the gun 10 via a tube duct 168 through an orifice 170. As such, the canister in the stock can be used as a reserve source of gas or for added capacity. Further, as shown in FIG. 17, the stock section 12 can be attached so that it can be detached and re-attached, whereby the user can replace the stock section 12 with another stock section having an air assembly adaptable to other sources of gas and also capable of retaining the sources of gas. The entire stock section 12 can be considered an integral module that plugs into the central section 14 and automatically seals via pre-installed O-Rings into grooves or tube ducts.

The present invention also provides for shock damping in the gun 10 such that different components of the gun 10 do not transfer unwanted shock to one another in order to prevent premature wear or undesired performance. Referring to FIG. 10, damping is provided in the piston assembly 132 wherein a piston seal 172, and bulk head cylinder seal 174 are utilized, each having a cross section of an hourglass. The shapes of the two seals improve shock absorption. As such, little or no kinetic motion transferred to the rest of the components of the gun 10.

Figure 18:
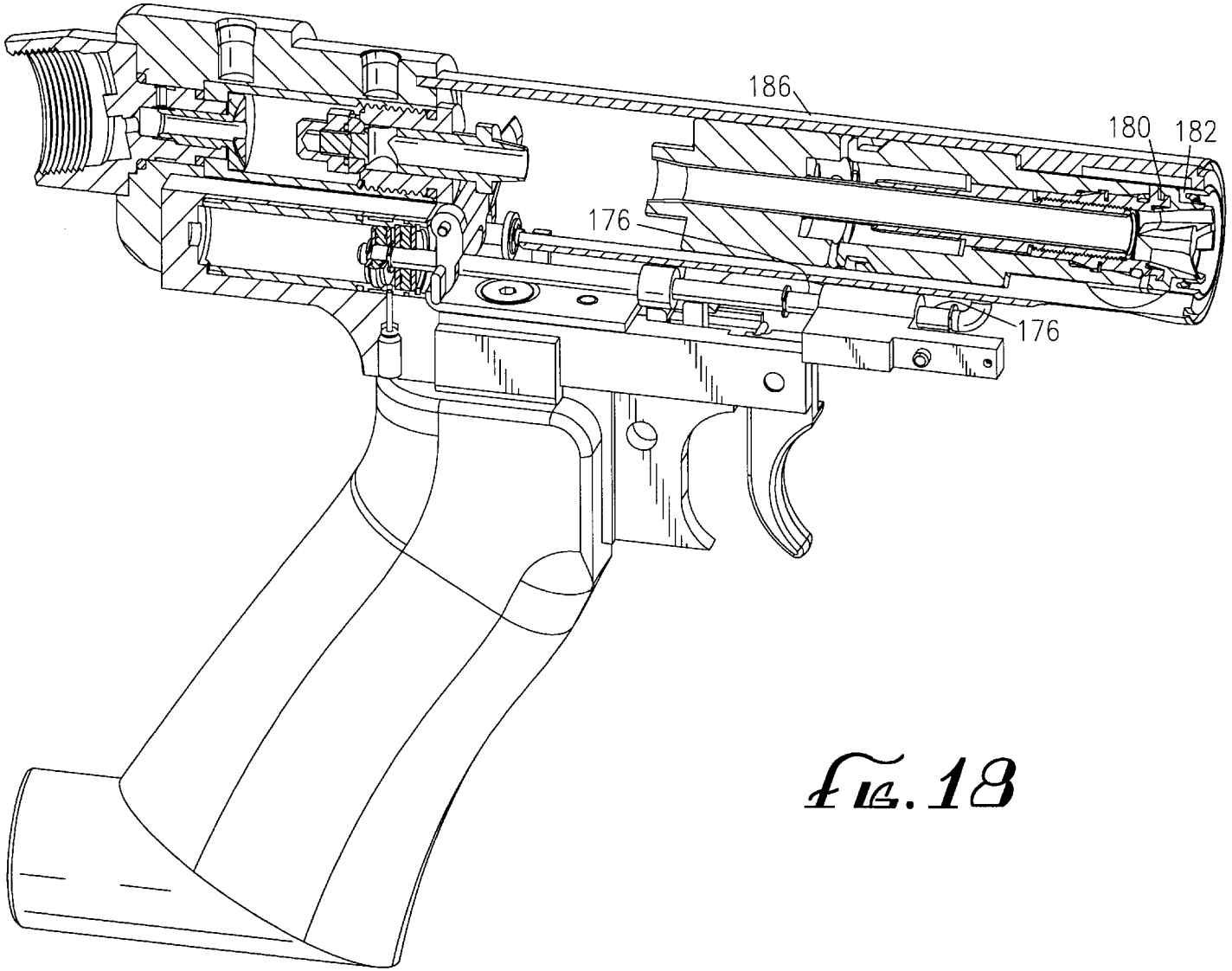
FIG. 18 is a perspective view with cut out section of the shock damping and diffuser components of the present invention.

A further shock dampening feature is shown in FIG. 18, where the connecting arm 146 of the piston assembly 132 carries two coupling springs 176 that contain and keep the coupling 78 of the drive cog assembly 60 centered. Referring to FIG. 6, in operation, as the cog 66 comes to rest on both forward and rearward motions, the piston assembly 132 is allowed to overstroke by compressing the springs 176 in order to allow for slight differences in cycle pressures that may change the characteristics of the piston assembly stroke.

The gun 10 of the present invention also provides for an in-line filtration mechanism 178, shown in FIG. 10, to prevent unwanted particles that may be present in high pressure gas from entering the firing mechanism 32.

Referring to FIGS. 7 and 8, the invention also provides a diffuser 180 attached to the bolt 82 to both diffuse and disperse the high frequency and violent burst of gas released from the valve 88, so that the high pressure gas is distributed as hemispherically as possible behind the projectiles. This prevents any unwanted pressure from being directed to a specific point behind a projectile causing the projectile to burst within the breech 26 or causing a vibration within the projectile making it seize and burst within the barrel 18. This hemispherical uniform dispersion of the gas pulse also prevents the outer walls of the projectile from expanding radially against the inner walls of the breech 26 or the central bore 20. The diffuser 180 can be adjusted to vary the firing velocity of the projectiles by controlling flow of gas through the diffuser 180 without a change in the distance between the diffuser 180 and the breech 26.

A further feature of the bolt and hammer assembly, shown in FIG. 18, is a bolt gland 182 which expands against the inner wall of a sleeve 186 when the pulse of gas is released behind the projectile, in order to retain the entire dwell pressure of the released gas. The gland 182 also functions as a flexible contact point with a projectile while the projectile is being transported vertically into the breech 26 while the bolt 82 is traveling rearward.

Another aspect of the invention is a waste gas magazine agitator to insure that the projectiles do not stick to one another while in the reservoirs. For example, paint balls contained in the forestock section 36 can stack and bind themselves together preventing a good flow of paint balls from the forestock section 36 to the primary magazine in the appendage 34. An agitator that can "jumble" the paint balls occasionally assures a good continued flow. One such means is redirection of vent or "waste gas" from the firing mechanism 32 of the gun 10 into the forestock section 36 or to the appendage 34.

Although the present invention has been described in considerable detail with reference to certain preferred versions thereof, other versions are possible. Therefore, the spirit and scope of the appended claims should not be limited to the description of the preferred versions contained herein.

What is claimed is:

1. A gas powered repeating gun capable of firing projectiles with compressed gas, the gun having a forward end and a rearward end and comprising:

(a) a central section having a proximal end and a distal end;

(b) a stock section disposed below and attached to the central section proximate to the proximal end of the central section;

(c) a barrel section attached to the distal end of the central section;

(d) a barrel disposed within the barrel section, the barrel having a longitudinal axis, a central bore, a proximal end and a distal end;

(e) a breech disposed proximate to the proximal end of the barrel;

(f) an appendage disposed below the central section forward of the stock section;

(g) a primary reservoir capable of retaining at least about 50 projectiles wherein the primary reservoir is disposed within the appendage;

(h) a conveyance mechanism capable of delivering projectiles from the primary reservoir to the breech at a rate greater than about 300 per minute;

(i) a firing mechanism capable of delivering discreet bursts of compressed gas to the breech and thereby firing projectiles at a rate greater than about 300 per minute;

(j) a forestock section disposed below the barrel section; and (k) a secondary reservoir capable of retaining projectiles, wherein the secondary reservoir is disposed within the forestock section;

wherein the conveyance mechanism is disposed within the appendage, and wherein the projectiles within the primary reservoir and the conveyance mechanism are under atmospheric pressure.

2. The gun of claim 1 wherein:

(a) the conveyance mechanism conveys projectiles from the primary reservoir; and (b) the forestock section is in communication with the appendage such that the secondary reservoir can provide projectiles to the primary reservoir, wherein projectiles are delivered from the secondary reservoir to the primary reservoir by the operation of gravity.

3. The gun of claim 1 wherein the conveyance mechanism comprises: (a) a revolving conveyer belt having a plurality of conveyer lugs each sized to receive and retain a projectile; and (b) a drive mechanism for revolving the conveyer belt.

4. The gun of claim 3 wherein the drive mechanism is powered by the firing mechanism of the gun for driving the conveyance mechanism.

5. The gun of claim 4 wherein:

(a) the drive mechanism comprises a drive cog assembly powered by the firing mechanism; and (b) the conveyer belt includes a conveyer chain corresponding to the drive cog assembly for engaging the drive cog assembly, whereby the drive cog assembly transmits successive motive force to the conveyer chain for revolving the conveyer belt.

6. The gun of claim 1 wherein the firing mechanism comprises:

(a) a bolt disposed within the central section rearward of the barrel, the bolt having a forward end, a rearward, and central bore having a longitudinal axis which is coaxial with the longitudinal axis of the barrel;

(b) a hammer slidably disposed within the central section immediately rearward of the bolt, the hammer having a forward end, a rearward end and a central bore, the central bore having a longitudinal axis which is coaxial with the central bore of the, barrel;

(c) cocking means for attaching the hammer to the bolt;

(d) trigger means for detaching the hammer from the bolt;

(e) a source of pressurized gas disposed within the central section;

(f) a valve for releasing a discrete burst of pressurized gas from the source to the breech and thereby firing projectiles through the central bore of the barrel;

(g) gas release actuation means responsive to the hammer for actuating the valve and releasing a discrete burst of gas;

(h) spring means for urging the hammer away from the bolt and into contact with the gas release actuation means; and (i) a piston assembly disposed in the central section for automatically cocking the gun, the piston assembly comprising: (1) a hollow sleeve having an open end and a closed end, a first aperture formed in the sleeve proximate the closed end, and a second aperture formed in the sleeve proximate the open end, wherein the first and the second apertures are sized to receive a flow of gas redirected to the apertures in sequence; (2) a piston slidably disposed within the sleeve in between the apertures; and (3) a connecting arm having a first end and a second end, the first end being connected to the piston, and the second end extending out of the second open end of the sleeve and being in communication with the bolt, wherein the open end of the sleeve is sized to snugly fit around the connecting arm while allowing the connecting arm to slide through the open end; wherein that pressure from said sequentially redirected flow of gas causes the piston to move and, via the connecting arm, urge the bolt toward the cocking means to cock the gun by attaching the hammer to the bolt, whereby the gun can repeatedly fire projectiles without the need for repeated manual cocking of the hammer in between firing of the projectiles.

7. A gas powered repeating gun capable of firing projectiles with compressed gas, the gun having a forward end and a rearward end and comprising:

(a) a central section having a proximal end and a distal end;

(b) a stock section disposed below and attached to the central section proximate to the proximal end of the central section;

(c) a barrel section attached to the distal end of the central section;

(d) a barrel disposed within the barrel section, the barrel having a longitudinal axis, a central bore, a proximal end and a distal end;

(e) a breech disposed proximate to the proximal end of the barrel;

(f) an appendage disposed below the central section forward of the stock section;

(g) a primary reservoir capable of retaining at least about 50 projectiles, wherein the primary reservoir is disposed within the appendage;

(h) a firing mechanism capable of delivering discrete bursts of compressed gas to the breech and thereby firing projectiles at a rate greater than about 300 per minute, the firing mechanism comprising: (i) a bolt disposed within the central section rearward of the barrel, the bolt having a forward end, a rearward end, and central bore having a longitudinal axis which is coaxial with the longitudinal axis of the barrel; (ii) a hammer slidably disposed within the central section immediately rearward of the bolt, the hammer having a forward end, a rearward end and a central bore, the central bore having a longitudinal axis which is coaxial with the central bore of the barrel; (iii) cocking means for attaching the hammer to the bolt; (iv) trigger means for detaching the hammer from the bolt; (v) a source of pressurized gas disposed within the central section; (vi) the source having a valve for releasing a discrete burst of pressurized gas from the source to the breech and thereby firing projectiles through the central bore of the barrel; (vii) gas release actuation means responsive to the hammer for actuating the valve and releasing a discrete burst of gas; (viii) spring means for urging the hammer away from the bolt and into contact with the gas release actuation means; (ix) a piston assembly disposed in the central section for automatically cocking the gun, the piston assembly comprising: (1) a hollow sleeve having an open end and a closed end, a first aperture formed in the sleeve proximate the closed end, and a second aperture formed in the sleeve proximate the open end, wherein the first and the second apertures are sized to receive a flow of gas redirected to the apertures in sequence; (2) a piston slidably disposed within the sleeve in between the apertures; and (3) a connecting arm having a first end and a second end, the first end being connected to the piston, and the second end extending out of the second open end of the sleeve and being in communication with the bolt, wherein the open end of the sleeve is sized to snugly fit around the connecting arm while allowing the connecting arm to slide through the open end; wherein that pressure from said sequentially redirected flow of gas causes the piston to move and, via the connecting arm, urge the bolt toward the cocking means to cock the gun by attaching the hammer to the bolt, whereby the gun can repeatedly fire projectiles without the need for repeated manual cocking of the hammer in between firing of the projectiles; and (i) a conveyance mechanism capable of delivering projectiles from the primary reservoir to the breech at a rate greater than about 300 per minute, the conveyance mechanism comprising a revolving conveyer belt having a plurality of conveyer lugs each sized to receive and retain a projectile, and a drive mechanism powered by the firing mechanism for revolving the conveyer belt, wherein the conveyance mechanism is disposed within the appendage and wherein the projectiles within the primary reservoir and the conveyance mechanism are under atmospheric pressure.

8. The gun of claim 7 further comprising:

(a) a forestock section disposed below the barrel section; and (b) a secondary reservoir capable of retaining projectiles, wherein the secondary reservoir is disposed within the forestock section.

9. The gun of claim 8 wherein:

(a) the conveyance mechanism conveys projectiles from the primary reservoir; and (b) the forestock section is in communication with the appendage such that the secondary reservoir can provide projectiles to the primary reservoir, wherein projectiles are delivered from the secondary reservoir to the primary reservoir by the operation of gravity.

10. The gun of claim 9 wherein:

(a) the drive mechanism of the conveyance mechanism comprises a drive cog assembly powered by the firing mechanism; and (b) the conveyer belt of the conveyance mechanism includes a conveyer chain corresponding to the drive cog assembly for engaging the drive cog assembly, whereby the drive cog assembly transmits successive motive force to the conveyer chain for revolving the conveyer belt.

* * * * *